US012628901B2

(12) United States Patent
Liao

(10) Patent No.: US 12,628,901 B2
(45) Date of Patent: May 19, 2026

(54) ASSEMBLY-TYPE LIGHT SANDALS

(71) Applicant: Chin-Wei Liao, Taipei City (TW)

(72) Inventor: Chin-Wei Liao, Taipei City (TW)

( * ) Notice: Subject to any disclaimer, the term of this patent is extended or adjusted under 35 U.S.C. 154(b) by 0 days.

(21) Appl. No.: 19/090,449

(22) Filed: Mar. 26, 2025

(65) Prior Publication Data

US 2025/0302139 A1 Oct. 2, 2025

(30) Foreign Application Priority Data

Mar. 26, 2024 (TW) ..... 113111263

(51) Int. Cl.
*A43B 3/12* (2006.01)

(52) U.S. Cl.
CPC ..... *A43B 3/12* (2013.01); *A43B 3/122* (2013.01)

(58) Field of Classification Search
CPC ..... A43B 3/12; A43B 3/122; A43B 3/126
USPC ..... 36/11.5
See application file for complete search history.

(56) References Cited

U.S. PATENT DOCUMENTS 3,121,962 A * 2/1964 Gullo ..... A43B 3/128 36/11.5
4,530,171 A * 7/1985 Zabala ..... A43B 3/126 36/11.5
2011/0239484 A1* 10/2011 Giovannetti ..... A43B 3/103 36/11.5
2012/0204441 A1* 8/2012 Conner ..... A43B 3/103 36/11.5
2013/0318829 A1* 12/2013 Opalacz ..... A43B 3/126 36/114
2013/0340285 A1* 12/2013 Blowers ..... A43B 3/122 36/101
2014/0165426 A1* 6/2014 Chapin ..... A43B 3/126 36/100
2015/0320141 A1* 11/2015 Collins ..... A43B 13/023 36/25 R
2016/0113350 A1* 4/2016 Sashen ..... A43B 3/126 36/11.5
2016/0242492 A1* 8/2016 Huang ..... A43B 3/122
2016/0302511 A1* 10/2016 Blowers ..... A43B 3/103
2017/0000209 A1* 1/2017 Huang ..... A43B 3/122
2017/0325539 A1* 11/2017 Yen ..... A43B 3/126
2018/0271207 A1* 9/2018 Ruggiero ..... A43B 3/242
2019/0320755 A1* 10/2019 Opalacz ..... A43B 3/122

FOREIGN PATENT DOCUMENTS

CN 102131415 7/2011
CN 203597454 5/2014

* cited by examiner

*Primary Examiner* — Marie D Bays
(74) *Attorney, Agent, or Firm* — Fei-hung Yang

(57) ABSTRACT

A kind of light sandals including a shoe sole, a front fixing member, at least two webbings, and a strap is provided. The webbings are arranged at a front surface of the shoe sole. Each of the webbings includes a circular belt at an upper end, and a front opening and a rear opening of the circular belt are respectively toward a front side and a rear side of the sandals. The strap forms a slip knot on the respective circular belts. When the slip knot is in a tightness adjustment state, a frontward strap and a backward strap respectively can be pulled continuously toward the front and the rear sides. When the slip knot is in a stop adjustment state, the frontward and the backward straps are respectively pulled tightly toward the front and the rear sides and secured on the corresponding circular belts.

10 Claims, 24 Drawing Sheets

ASSEMBLY-TYPE LIGHT SANDALS

CROSS-REFERENCE TO RELATED APPLICATIONS

This non-provisional application claims priority under 35 U.S.C. § 119(a) on Patent Application No(s). 113111263 filed in Taiwan, R.O.C. on Mar. 26, 2024, the entire contents of which are hereby incorporated by reference.

BACKGROUND OF THE INVENTION

The present invention relates to sandals, especially to a kind of assembly-type light sandals.

Among modern sandals, a kind of sandals uses a strap to fix user's heel. The sandals are light and easy to put on and take off so that they are quite popular by outdoor sportsmen. Such kind of products are often with an assembly-type design for allowing users to disassemble the sandals and carry respective parts easily. However, the tightness of the strap of the sandals available now can't be adjusted over various stages or at different areas of the sandals. The strap used now is unable to be adjusted according to different areas of the user's foot including a width of the forefoot and a thickness of the instep. The strap can only be adjusted once for changing fitness between the sandals and the whole foot. Thus the sandals can't give users a good experience while in use. These facts result in a decrease in competitiveness of the product in the market.

Moreover, some of the sandals available now use locking rings or fasteners to adjust the tightness of the strap. Thus cost required is increased and this affects cost reduction in manufacturing.

Thus there is room for improvement and there is a need to provide a kind of assembly-type sandals in which tightness at different areas of the sandals (such as a width of the forefoot and a thickness of the instep) is able to be adjusted and having lower manufacturing cost.

SUMMARY OF THE INVENTION

Therefore, it is a primary object of the present invention to provide a kind of light sandals including a shoe sole, a front fixing member, at least two webbings, and a strap. The respective webbings are arranged at a front surface of the shoe sole. Each of the webbings consists of a circular belt located at an upper end of the webbing. A front opening and a rear opening of the circular belt are respectively toward the front side and the rear side. When the slip knot is in a tightness adjustment state, a frontward strap and a backward strap of the slip knot can be respectively pulled toward the front side and the rear side continuously. When the slip knot is in a stop adjustment state, the frontward strap and the backward strap are respectively pulled tightly toward the front side and the rear side and then secured on the corresponding circular belts. Thereby the problem of the sandals available now that adjustment is unable to be performed at different areas can be solved.

In order to achieve the above object, a kind of assembly-type light sandals worn by user's sole has a front side, a rear side, an inner side, and an outer side defined according to positions corresponding to user's sole. The assembly-type light sandals include a shoe sole, a front fixing member, at least two webbings, and a strap. According to directions of the front side and the rear side, the shoe sole includes a front part, a middle part, and a rear part in turn. The shoe sole is provided with a front surface and a back surface. The front fixing member is detachably mounted to the front part of the shoe sole. The respective webbings are detachably disposed on the front surface of the shoe sole and each of the webbings includes a circular belt and a fixing end. The circular belt is located at an upper end of the webbing while a front opening and a rear opening of the circular belt are respectively toward the front side and the rear side. The fixing end is located opposite to the circular belt, at a lower end of the webbing for being fixed on the shoe sole. The strap is detachably arranged at the shoe sole and having a circular cross section. The strap forms a slip knot on each of the circular belts. The strap is pulled through the respective circular belts toward the rear side and tied on the respective circular belts to form the respective slip knots in turn. The strap is inserted through the circular belt toward the rear side, then wrapped around the outer side, and lastly inserted through the circular belt toward the rear side again and tied on the circular belt to form the slip knot in turn. A part of the strap firstly inserted through the circular belt is pressed under a part of the strap inserted through again later to form a backward strap while a part of the strap pressing the backward strap forms a frontward strap. The respective slip knots are located within the outer side, opposite to the inner side. When the slip knot is in a tightness adjustment state, the frontward strap and the backward strap can be respectively pulled toward the front side and the rear side continuously. When the slip knot is in a stop adjustment state, the frontward strap and the backward strap are respectively pulled tightly toward the front side and the rear side and then secured on the) corresponding circular belts. While being assembled, the front fixing member and the respective webbings are mounted to the shoe sole. Then one end of the strap is fixed on the front fixing member. Next the other end of the strap is inserted through the circular belts of the webbings in turn from the front side to the rear side. The strap is firstly forming the slip knot in the circular belt of the previous webbing and then is inserted through the circular belt of the next webbing. At last the strap is fixed to complete assembly of the light sandals. A segment of the strap between the front fixing member and the respective slip knots, or between the two adjacent slip knots is used to fix the user's sole on the front surface of the shoe sole. In the tightness adjustment state, a length of the strap between the front fixing member and the respective slip knots or a length of the strap between the two adjacent slip knots can be shortened or increased. In the stop adjustment state, the length of the strap between the front fixing member and the respective slip knots, or the length of the strap between the two adjacent slip knots is fixed. The above design makes the present product more competitive on the market.

Preferably, a diameter of the cross section of the strap is ranging from 2 mm to 7 mm.

Preferably, the front surface of the shoe sole is further provided with a plurality of fixing slots. The front fixing member and the fixing end of each of the webbings are mounted into the corresponding fixing slots of the shoe sole.

Preferably, a plurality of insertion holes is disposed on the shoe sole. A bottom of the front fixing member is further provided with a stopping portion. The front fixing member is inserted through the insertion hole on the front part of the shoe sole from bottom to top and then abutting against the insertion hole by the stopping portion to be secured on the shoe sole.

Preferably, the front part, the middle part, and the rear part of the shoe sole are further provided with a plurality of insertion holes. The fixing end of the webbing is a T-shaped abutting member formed by two pieces of webbings combined with glue dispensing fixing technique. The respective webbings are inserted through the corresponding insertion holes from bottom to top and then abutting against the insertion holes by the T-shaped abutting members to be secured on the shoe sole.

Preferably, the front fixing member further includes a front fixing webbing which is provided with a ring band. While being assembled, the strap firstly forms a front fixing knot on the ring band of the front fixing webbing and then inserted toward the rear side. The front fixing knot is located at the outer side, opposite to the inner side.

Preferably, the number of the webbings of the light sandals is three. The webbings include a first webbing, a second webbing, and a third webbing. After one end of the strap being fixed, the other end of the strap is inserted through the circular belt of the first webbing to form one of the slip knots and then inserted through the circular belt of the second webbing to form another one of the slip knots. Next the strap is inserted through a first ring of a quick plug-in buckle on the outer side and the circular belt of the third webbing in turn and a further one of the slip knots is formed on the circular belt of the third webbing. Later the strap is inserted through a second ring of the quick plug-in buckle and returned to the circular belt of the third webbing. At last the other end of the strap is fixed on a segment of the strap between the circular belt of the third webbing and the first ring. Both the segment of the strap between the circular belt of the third webbing and the first ring and a segment of the strap between the circular belt of the third webbing and the second ring are used for fixing a user's heel. The quick plug-in buckle is used to adjust a length of the segment of the strap between the circular belt of the third webbing and the first ring or a length of the segment of the strap between the circular belt of the third webbing and the second ring.

Preferably, the number of the webbings of the light sandals is two. The webbings include a first webbing and second webbing. The light sandals further include a middle fastener located at a space above the middle part of the shoe sole and composed of a ring belt, a first ring, a mounting space, a fixing piece, and a second ring. The first ring and the second ring are both communicating with the mounting space while the fixing piece is located in the mounting space and arranged between the first ring and the second ring. After one end thereof being fixed, the other end of the strap is pulled through the ring belt of the middle fastener and a slip knot is formed. Then the strap is further inserted through the circular belt of the first webbing and another slip knot is formed. Next the strap is pulled from the rear side toward the front side and inserted through the circular belt of the second webbing to form a further slip knot. Later the strap is inserted through the first ring of the middle fastener and pulled out of the middle fastener to be inserted through the second ring of the middle fastener. The strap is protruding from the middle fastener and pulled tightly to be in a fixed state. Now the fixing piece in the mounting space tightens and positions a segment of the strap from the first ring to the second ring on the middle fastener. A segment of the strap between the circular belt of the first webbing and the circular belt of the second webbing is used to fix the user's heel. The middle fastener is for adjusting a length of a segment of the strap between the circular belt of the second webbing and the second ring.

Preferably, the webbings of the rear part of the shoe sole are connected into one part by a heel webbing with adjustable length. The heel webbing is used to fix the user's heel.

Preferably, before being mounted to the shoe sole, the front fixing member and the webbings are first applied with glues by glue dispensing techniques and then mounted to the shoe sole.

DETAILED DESCRIPTION OF THE PREFERRED EMBODIMENT

Figure 1:
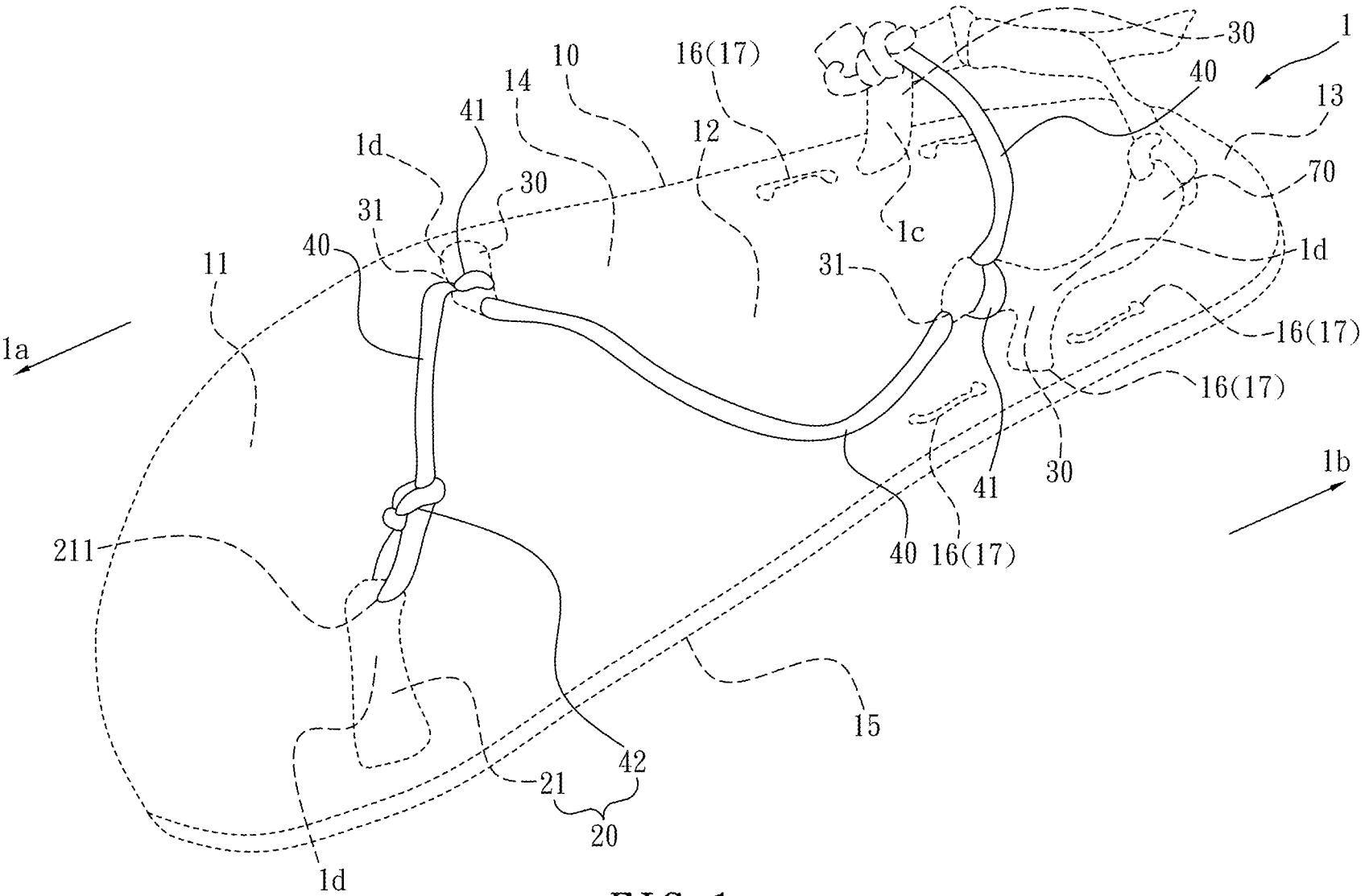
FIG. 1 is a perspective view of an embodiment (light sandals with a heel webbing) according to the present invention.
Figure 13:
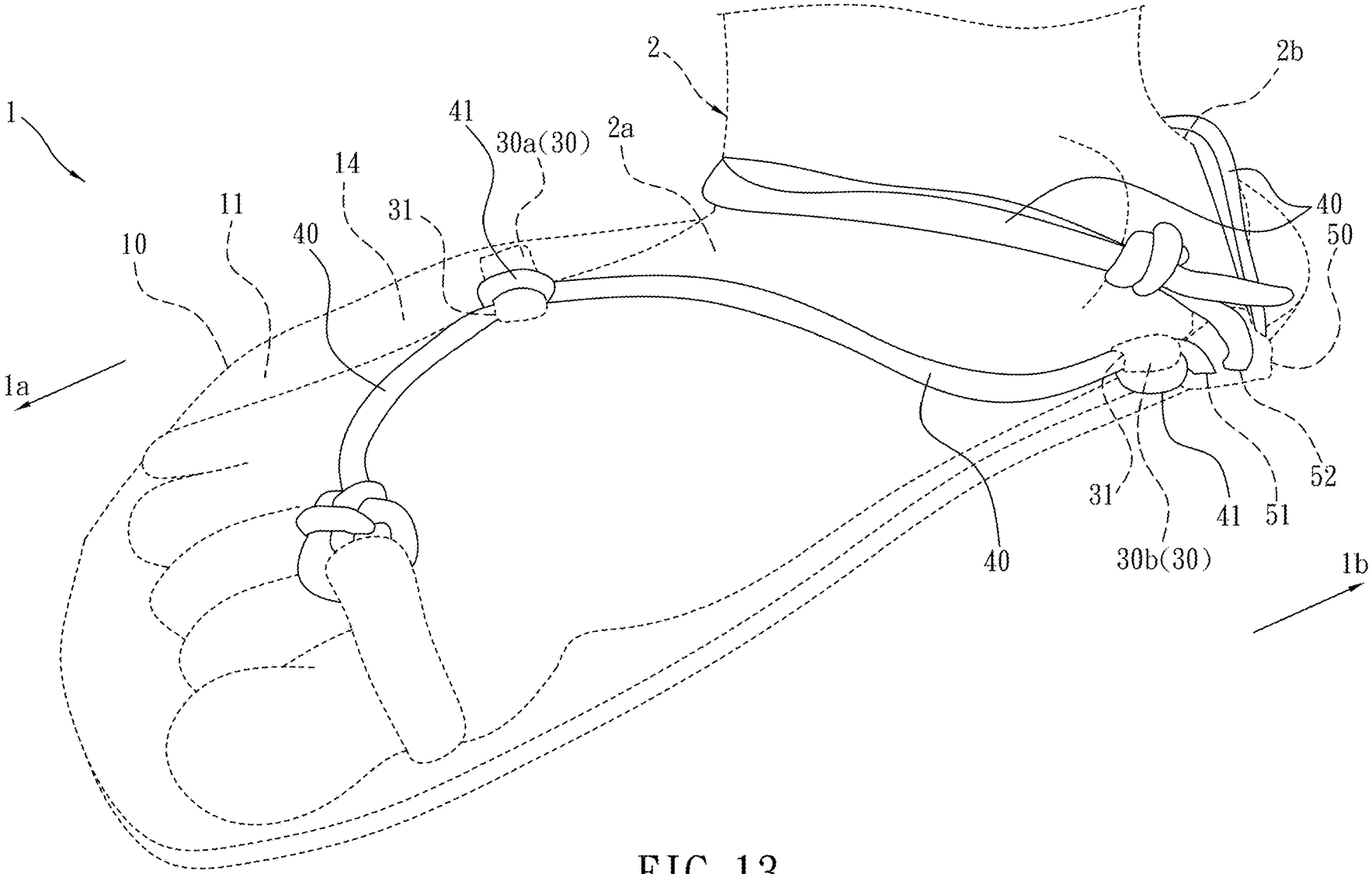
FIG. 13 is a perspective view showing an embodiment of light sandals in use according to the present invention.
Figure 25:
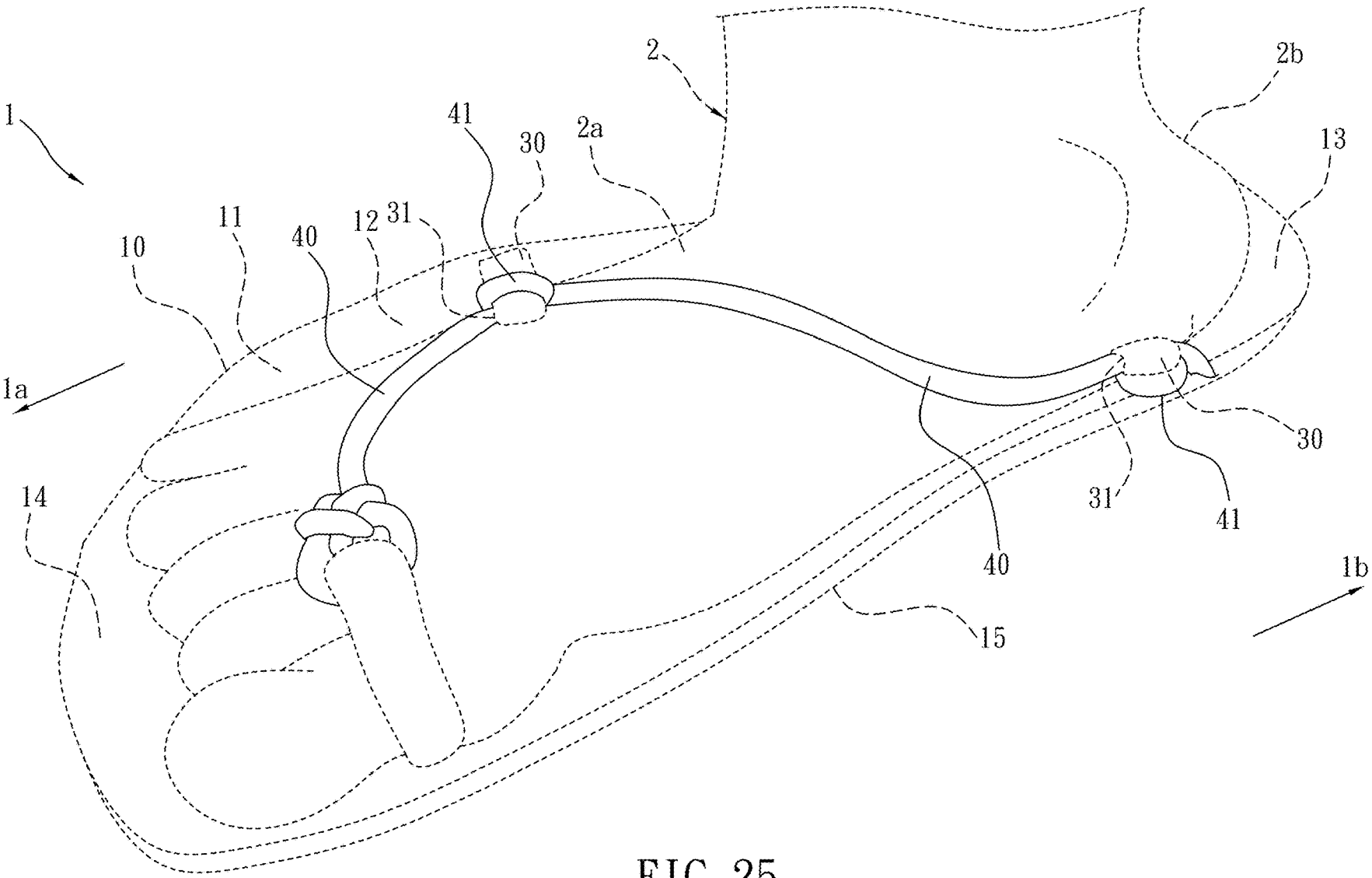
FIG. 25 is a perspective view showing an embodiment in use according to the present invention.

Refer to FIG. 1, FIG. 7, FIG. 16, and FIG. 22, a kind of assembly-type light sandals 1 according to the present invention is worn by a user's 2 sole 2*a*, as shown in FIG. 13 and FIG. 25. According to positions with respect to the user's 2 sole 2*a*, the light sandals 1 has a front side 1*a*, a rear side 1*b*, an inner side 1*c*, and an outer side 1*d*, as shown in FIG. 1. The light sandals 1 includes a shoe sole 10, a front fixing member 20, at least two webbings 30, and a strap 40.

According to directions of the front side 1*a* and the rear side 1*b*, the shoe sole 10 includes a front part 11, a middle part 12, and a rear part 13 in turn, as shown in FIG. 1, FIG. 22-25. Also refer to FIG. 1-4, the shoe sole 10 is provided with a front surface 14 and a back surface 15.

As shown in FIG. 1, FIG. 7, FIG. 16, and FIG. 22, the front fixing member 20 is detachably mounted to the front part 11 of the shoe sole 10 so that users can disassemble the front fixing member 20 for easy carrying.

Figure 14:
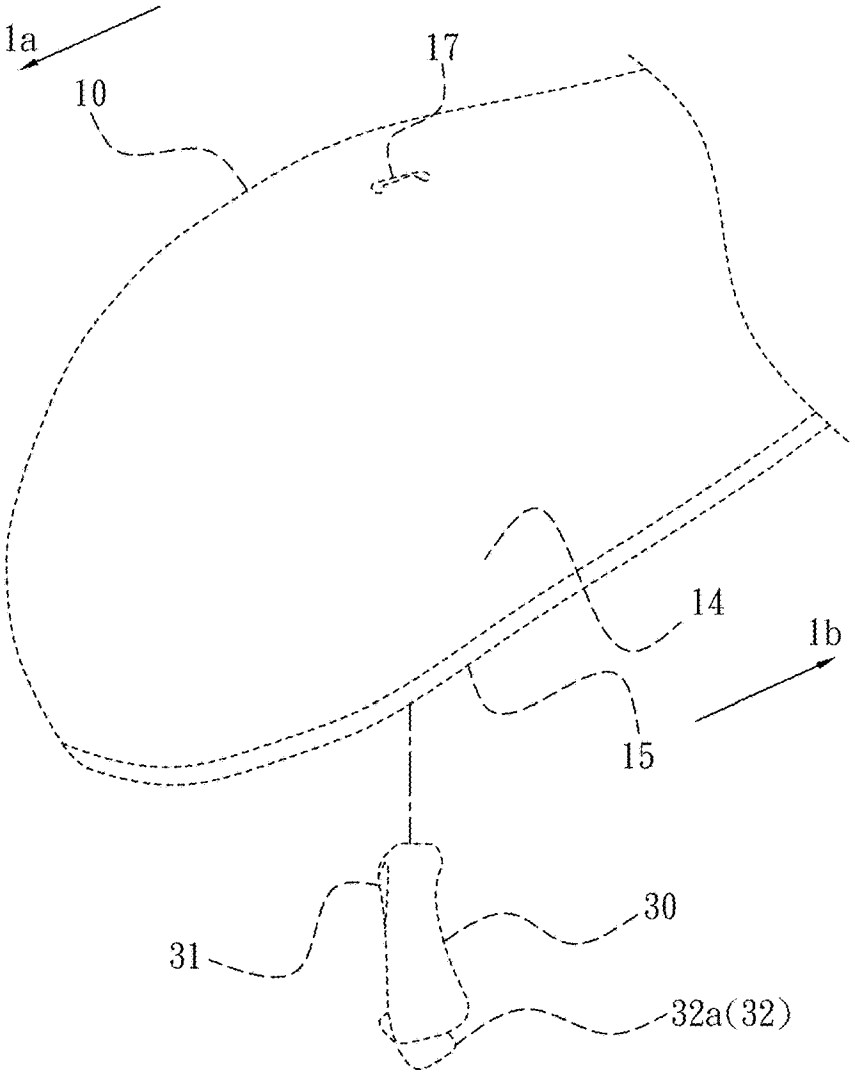
FIG. 14 is a schematic drawing showing insertion of a webbing through an insertion hole from bottom to top according to the present invention.

As shown in FIG. 1, FIG. 7, FIG. 16, and FIG. 22, the respective webbings 30 are detachably disposed on the front surface 14 of the shoe sole 10 so that users can disassemble the webbings 30 for easy carrying. Each of the webbings 30 includes a circular belt 31, and a fixing end 32, as shown in FIG. 14. The circular belt 31 is located at an upper end of the respective webbings 30 and a front opening and a rear opening of the circular belt 31 are respectively toward the front side 1*a* and the rear side 1*b*, as shown FIG. 5 and FIG. 6. As shown in FIG. 14, the fixing end 32 is located opposite to the circular belt 31, at a lower end of the respective webbings 30 for being fixed on the shoe sole 10.

Figure 5:
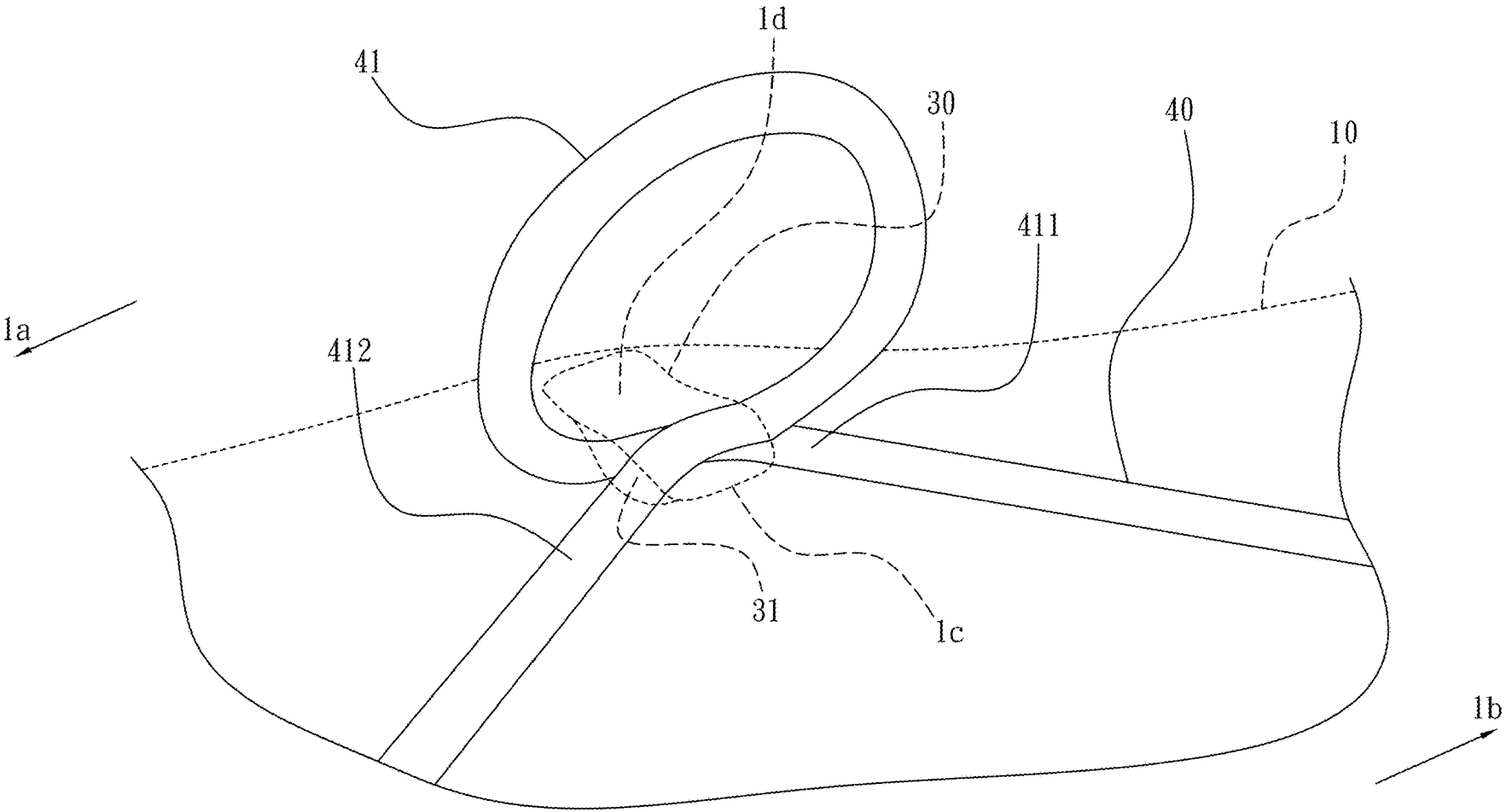
FIG. 5 is a partial enlarged view showing a strap in a tightness adjustment state of an embodiment according to the present invention.
Figure 6:
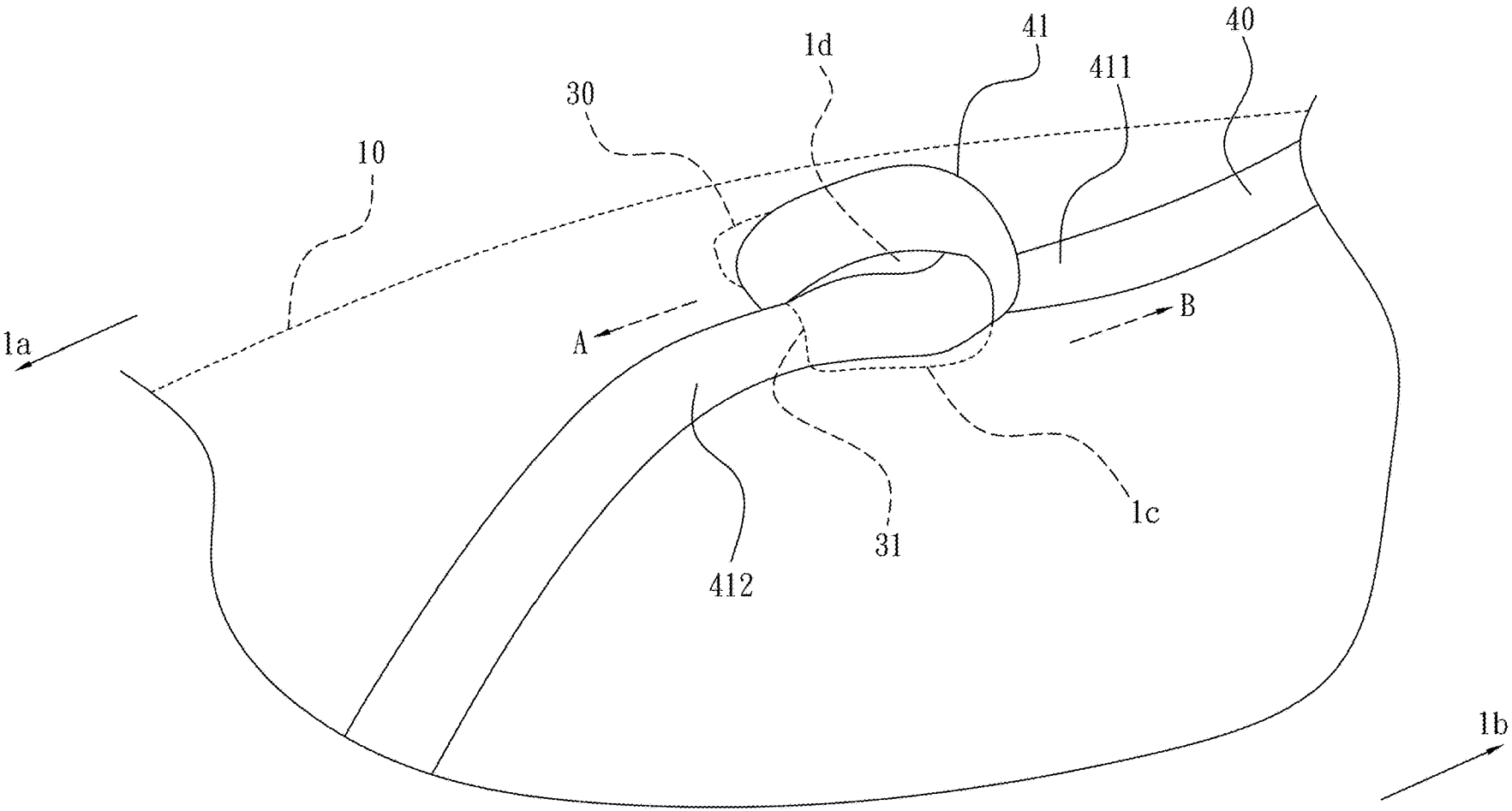
FIG. 6 is a partial enlarged view showing a strap in a stop adjustment state of an embodiment according to the present invention.
Figure 7:
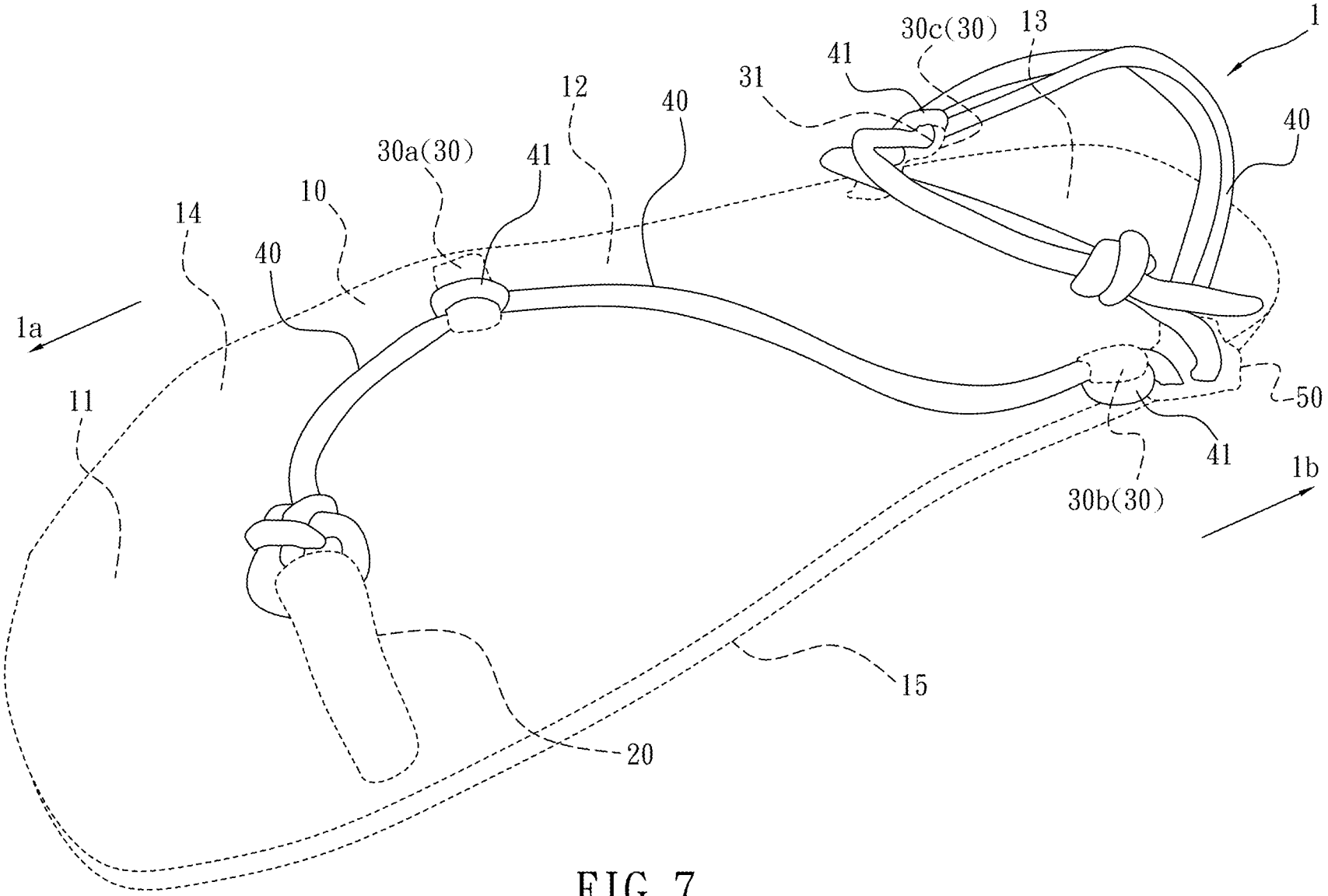
FIG. 7 is a perspective view of another embodiment (light sandals with a quick plug-in buckle) according to the present invention.
Figure 8:
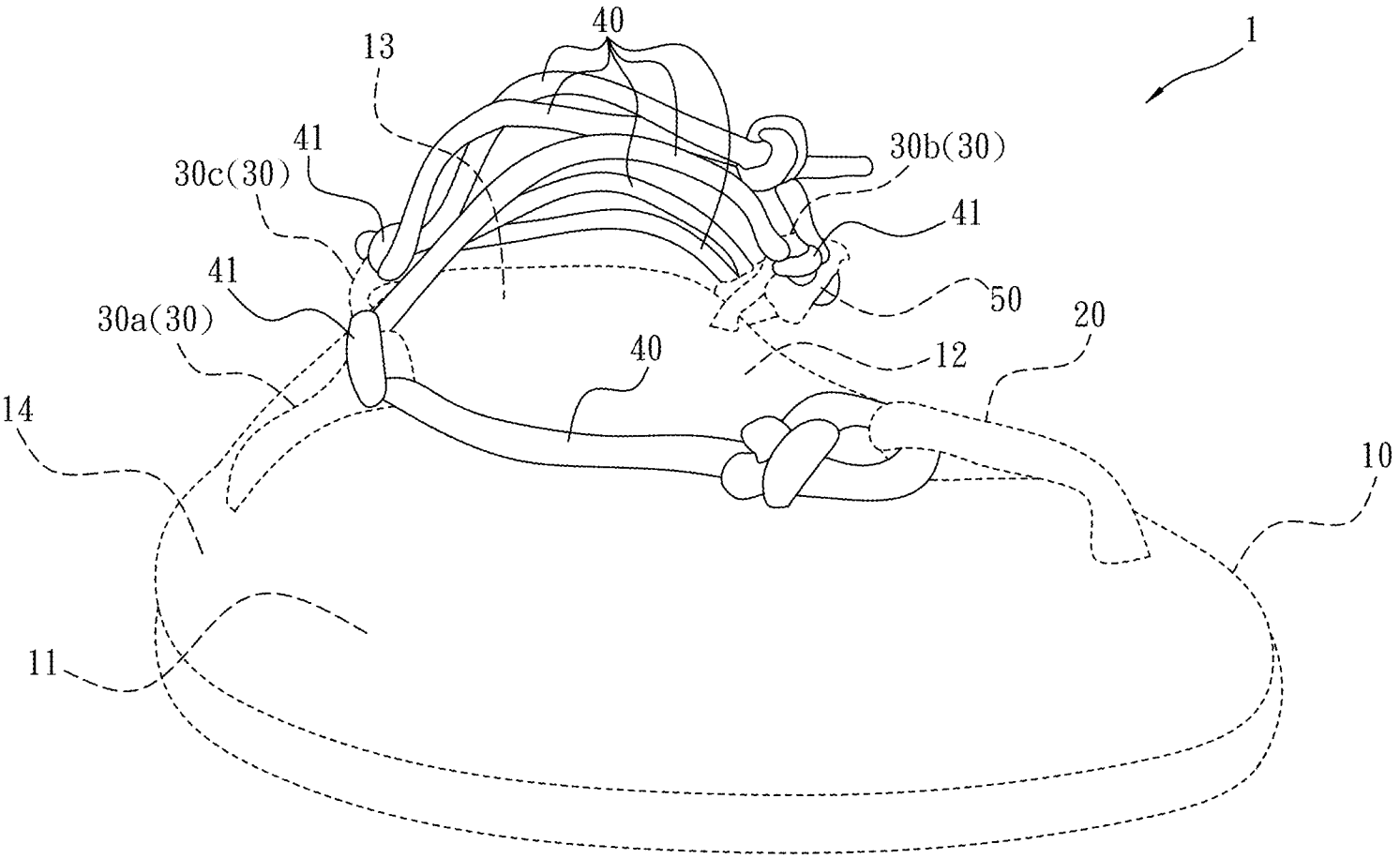
FIG. 8 is the embodiment in FIG. 7 viewed from another angle according to the present invention.
Figure 9:
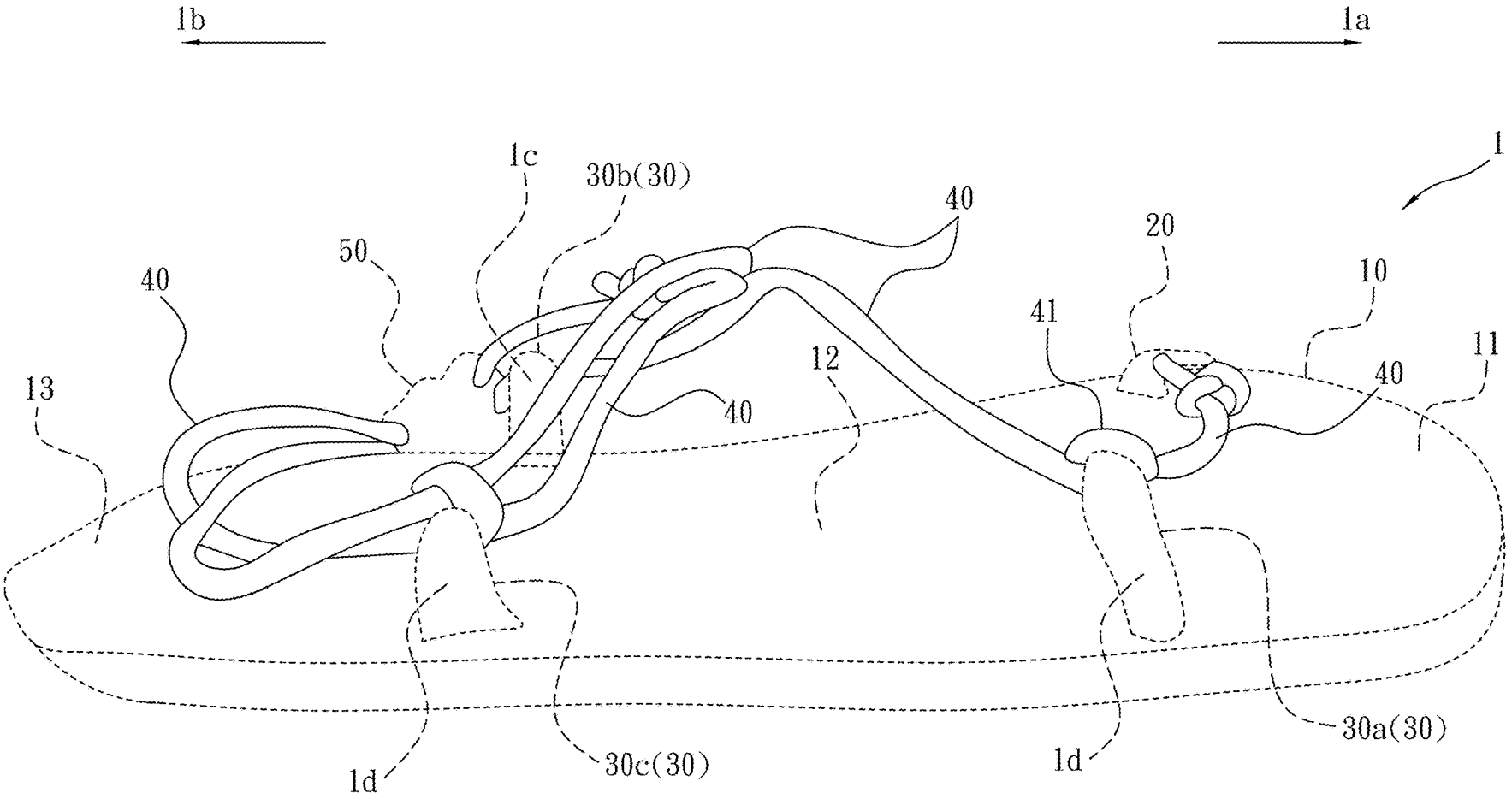
FIG. 9 is the embodiment in FIG. 7 viewed from a further angle according to the present invention.

Refer to FIG. 1, FIG. 7, FIG. 16, and FIG. 22, the strap 40 is detachably arranged at the shoe sole 10 so that users can disassemble the strap 40 for easy carrying. Also refer to FIG. 15, a cross section of the strap 40 is a circle. As shown in FIG. 1, the strap 40 forms a slip knot 41 on the respective circular belts 31. The strap 40 is pulled through the respective circular belts 31 toward the rear side 1*b* and tied on the respective circular belts 31 to form the respective slip knots 41 in turn. Refer to FIG. 5 and FIG. 6, the strap 40 is firstly inserted through the circular belt 31 toward the rear side 1*b*, then wrapped around the outer side 1*d* (made a loop), and lastly inserted through the circular belt 31 toward the rear side 1*b* again and tied on the circular belt 31 to form the slip knot 41. A part of the strap 40 firstly inserted through the circular belt 31 is pressed under a part of the strap 40 inserted through again later to form a backward strap 411 while a part of the strap 40 pressing the backward strap 411 forms a frontward strap 412. The respective slip knots 41 are located in a range of the outer side 1*d*, opposite to the inner side 1*c*. Thus user's foot will not feel uncomfortable due to the slip knots 41. Refer to FIG. 5, when the slip knot 41 is in a tightness adjustment state, the frontward strap 412 and the backward strap 411 can be respectively pulled toward the front side 1*a* (as an arrow A in FIG. 6 indicates) and toward the rear side 1*b* (as an arrow B in FIG. 6 indicates) continuously. Refer to FIG. 6, when the slip knot 41 is in a stop adjustment state, the frontward strap 412 and the backward strap 411 are respectively pulled tightly toward the front side 1*a* and the rear side 1*b* and then secured on the corresponding circular belts 31.

Refer to FIG. 1, FIG. 7, FIG. 16, and FIG. 22, while being assembled, the front fixing member 20 and the respective webbings 30 are mounted to the shoe sole 10 in the beginning. Then one end of the strap 40 is fixed on the front fixing member 20. Next the other end of the strap 40 is inserted through the circular belts 31 of the webbings 30 in turn from the front side 1*a* to the rear side 1*b*. The strap 40 is firstly forming the slip knot 41 in the circular belt 31 of the previous webbing 30 and then inserted through the circular belt 31 of the next webbing 30. At last the strap 40 is fixed to complete assembly of the light sandals 1.

As shown in FIG. 13 and FIG. 25, a segment of the strap 40 between the front fixing member 20 and the respective slip knots 41, or between the two adjacent slip knots 41 is used to fix the user's 2 sole 2*a* on the front surface 14 of the shoe sole 10.

In the tightness adjustment state (as shown in FIG. 5), a length of the segment of the strap 40 between the front fixing member 20 and the respective slip knots 41 or a length of the segment of the strap 40 between the two adjacent slip knots 41 can be shortened or increased, as shown in FIG. 1.

In the stop adjustment state (as shown in FIG. 6), the length of the strap 40 between the front fixing member 20 and the respective slip knots 41, or the length of the strap 40 between the two adjacent slip knots 41 is fixed, as shown in FIG. 1.

Figure 15:
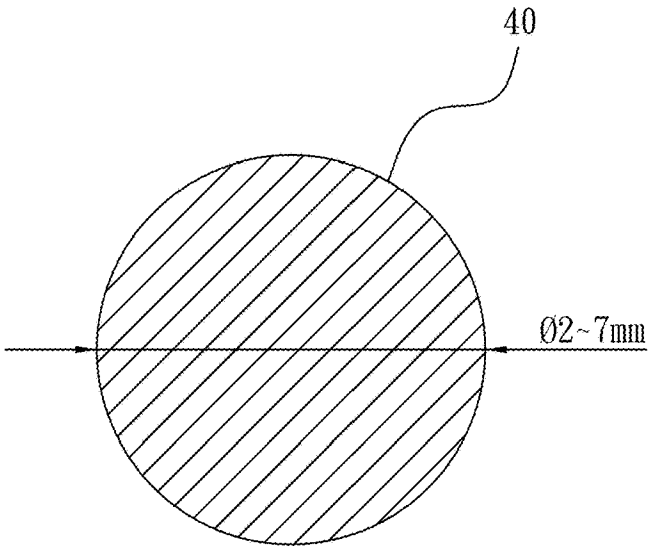
FIG. 15 is a sectional view of a strap of an embodiment according to the present invention.

Refer to FIG. 15, a diameter of the cross section of the strap 40 is ranging from 2 mm to 7 mm, but not limited for providing users comfortable wearing experience.

Figure 2:
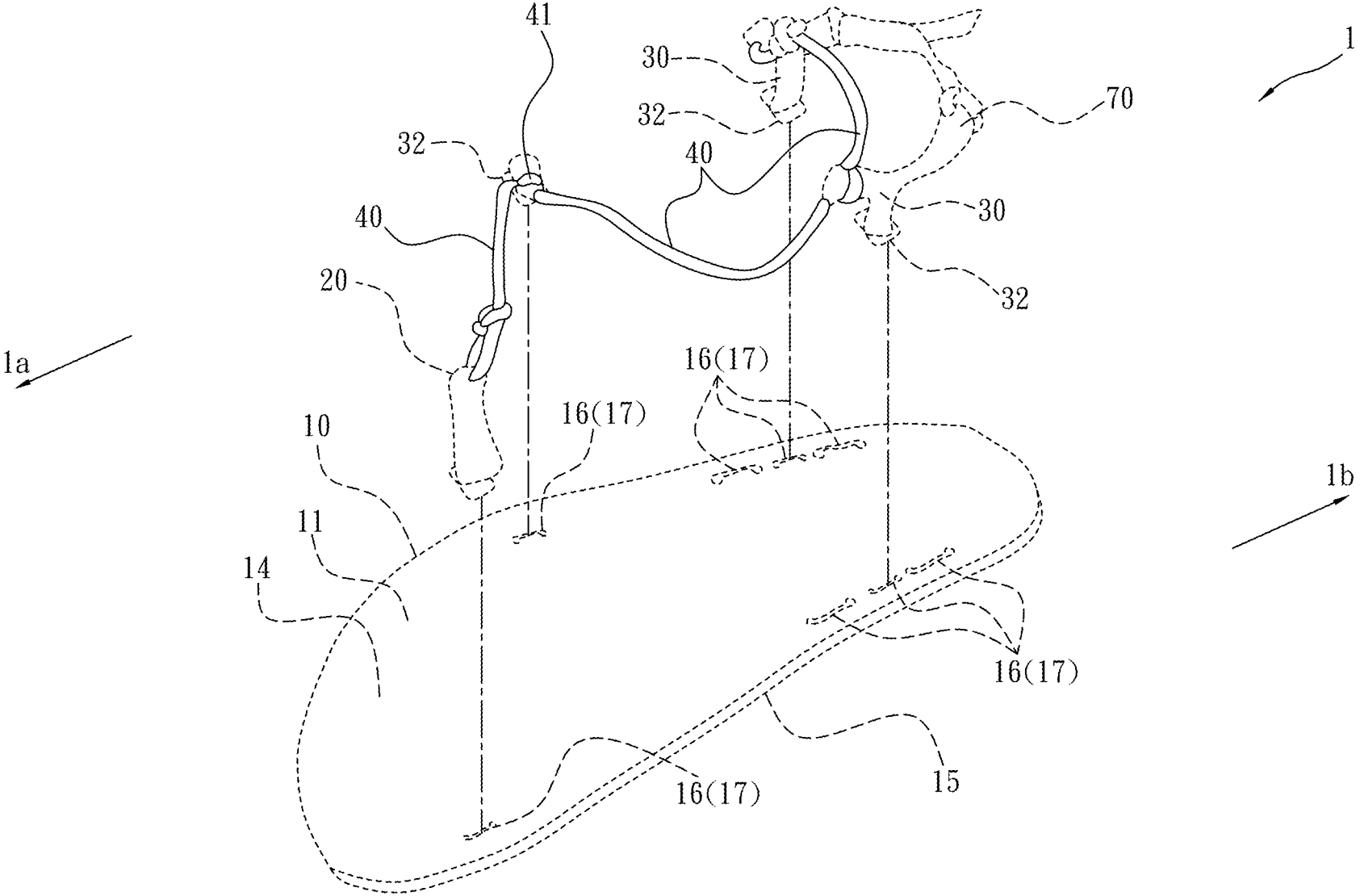
FIG. 2 is an exploded view of the embodiment in FIG. 1 according to the present invention.
Figure 3:
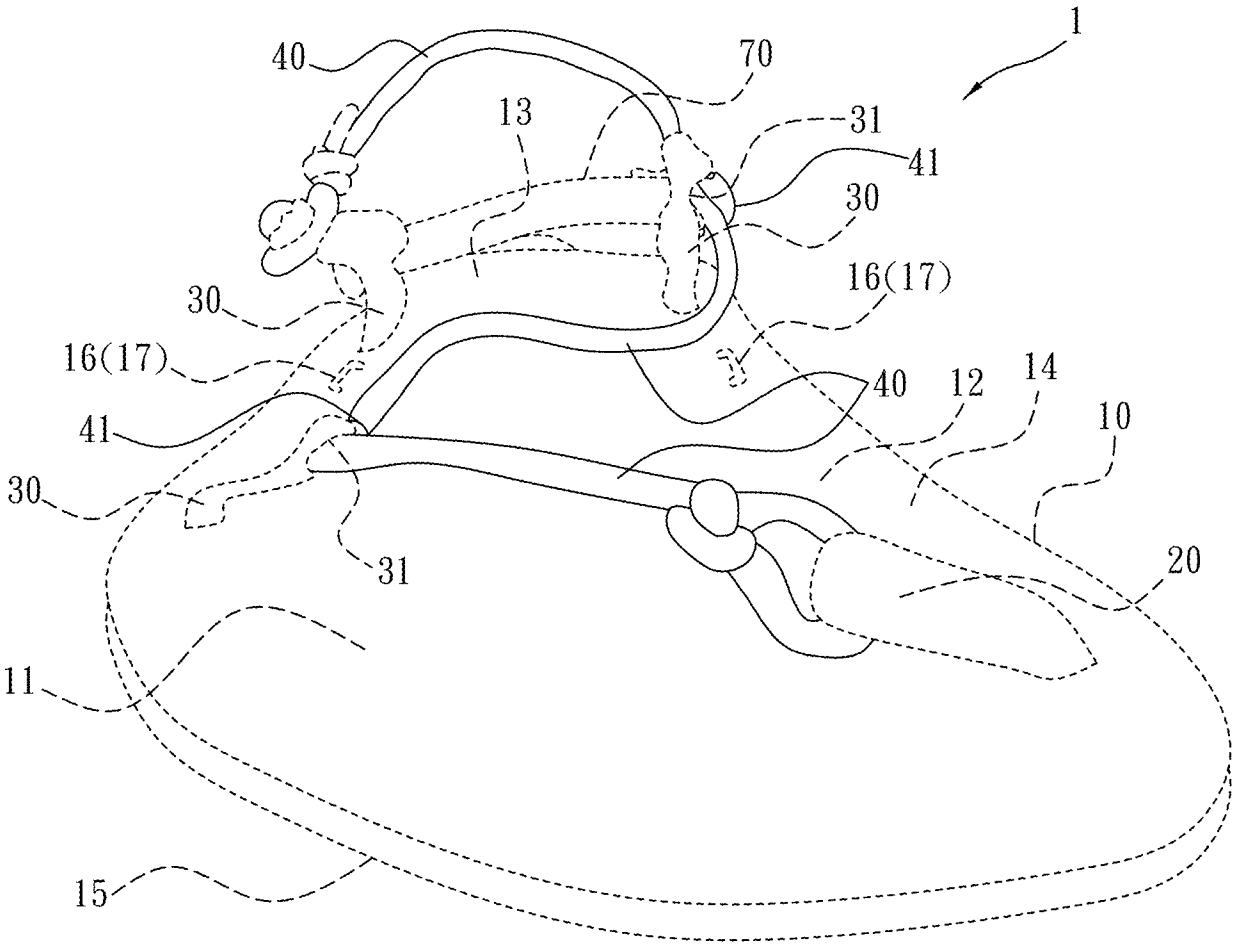
FIG. 3 is the embodiment in FIG. 1 viewed from another angle according to the present invention.
Figure 4:
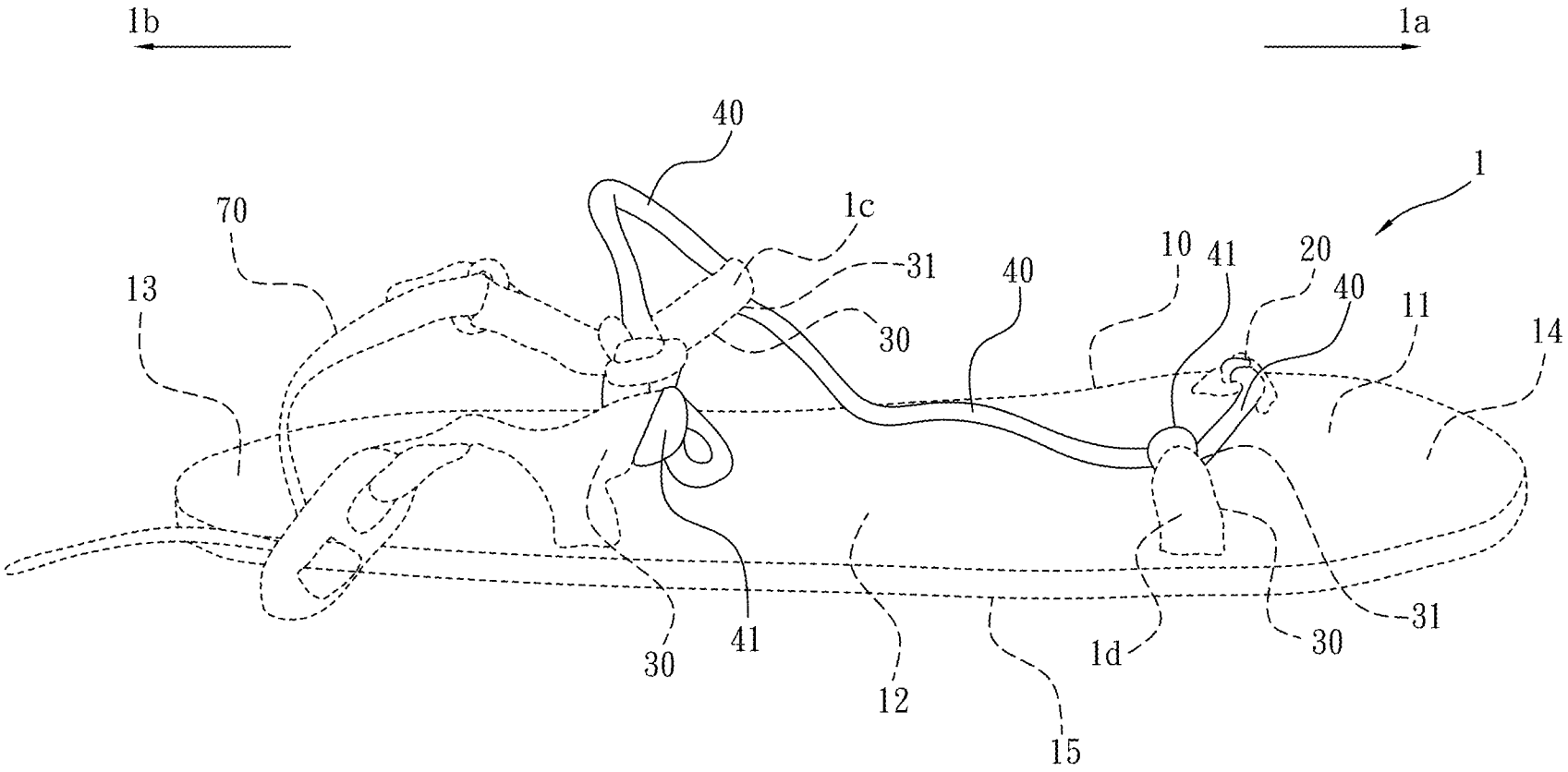
FIG. 4 is the embodiment in FIG. 1 viewed from a further angle according to the present invention.

Refer to FIG. 2, the front surface 14 of the shoe sole 10 is further provided with a plurality of fixing slots 16, but not limited. The front fixing member 20 and the fixing end 32 of the respective webbings 30 are mounted into the respective fixing slots 16 correspondingly and such design helps users assemble the light sandals 1 easily.

Figure 21:
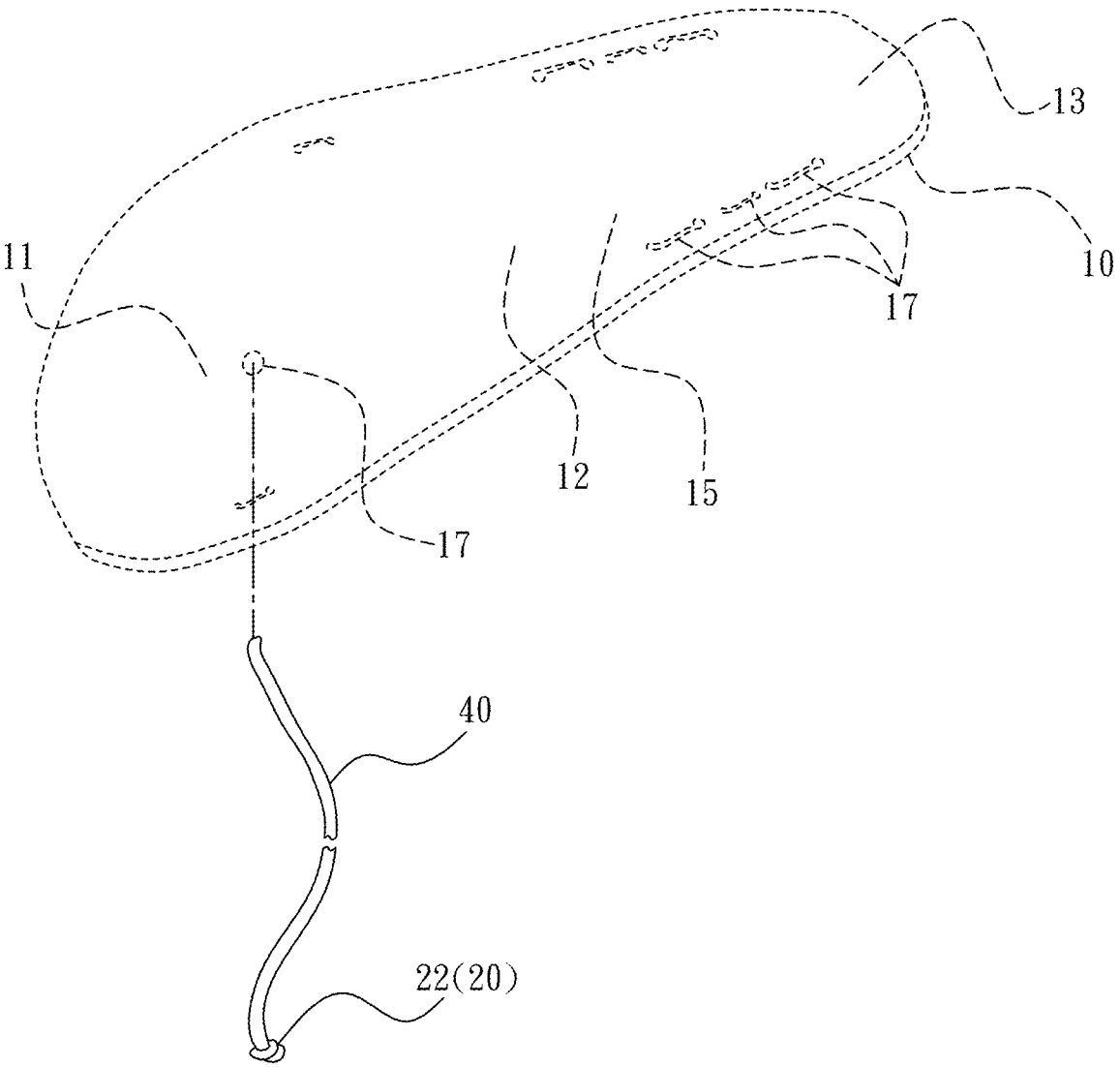
FIG. 21 is a schematic drawing showing bottom-up insertion of a front fixing member (with a stopping portion) through an insertion hole according to the present invention.
Figure 22:
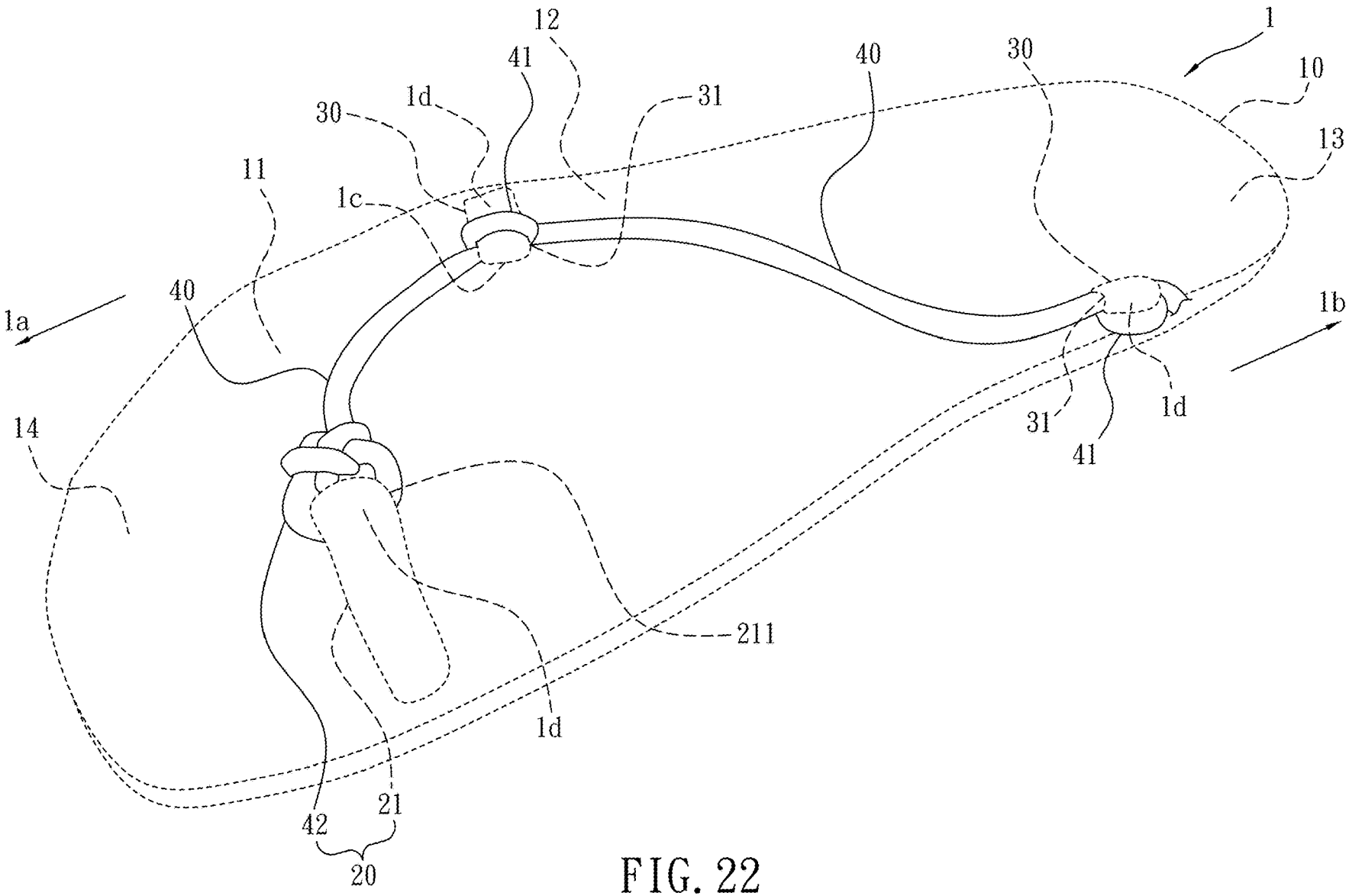
FIG. 22 is a perspective view of another embodiment (light sandals with two webbings) according to the present invention.
Figure 23:
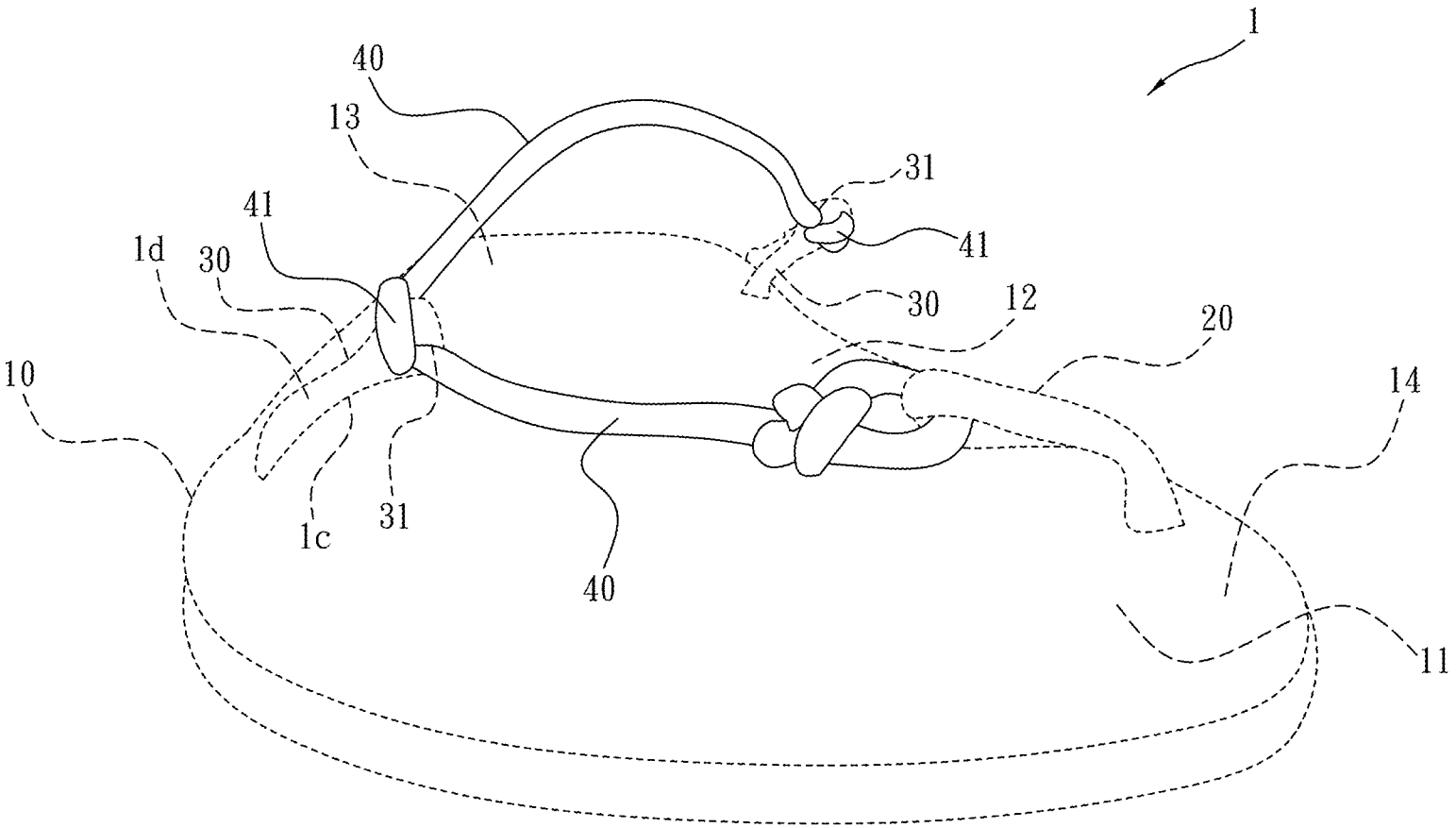
FIG. 23 is the embodiment in FIG. 22 viewed from another angle according to the present invention.
Figure 24:
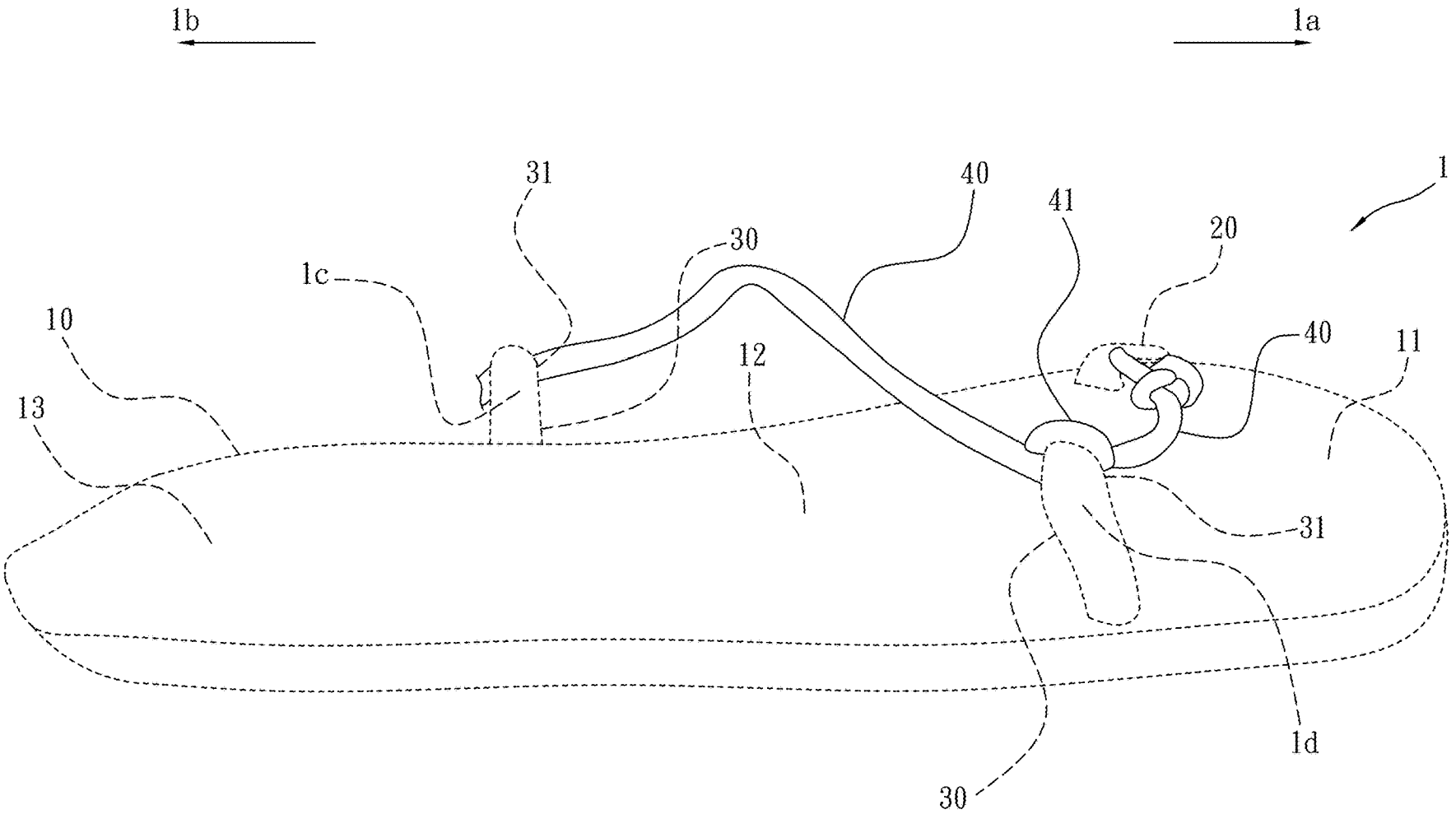
FIG. 24 is the embodiment in FIG. 22 viewed from a further angle according to the present invention.

Refer to FIG. 21, the shoe sole 10 is further provided with a plurality of insertion holes 17, but not limited. A bottom of the front fixing member 20 is further provided with a stopping portion 22, but not limited. The front fixing member 20 is inserted through the insertion hole 17 on the front part 11 of the shoe sole 10 from bottom to top and then abutting against the insertion hole 17 by the stopping portion 22 to be secured on the shoe sole 10.

Refer to FIG. 2, the front part 11, the middle part 12, and the rear part 13 of the shoe sole 10 are further provided with a plurality of insertion holes 17. The fixing end 32 of the respective webbings 30 is a T-shaped abutting member 32*a* formed by two pieces of webbings combined with glue dispensing fixing technique, but not limited, as shown in FIG. 14. The respective webbings 30 are inserted through the corresponding insertion holes 17 from bottom to top and then abutting against the insertion holes 17 by the T-shaped abutting members 32*a* to be fixed on the shoe sole 10, as shown in FIG. 14.

Refer to FIG. 1, the front fixing member 20 further includes a front fixing webbing 21, but not limited. The front fixing webbing 21 is provided with a ring band 211. While being assembled, the strap 40 firstly forms a front fixing knot 42 on the ring band 211 of the front fixing webbing 21 and then inserted toward the rear side 1*b*, but not limited. The front fixing knot 42 is located at the range of the outer side 1*d*, opposite to the inner side 1*c*.

Figure 10:
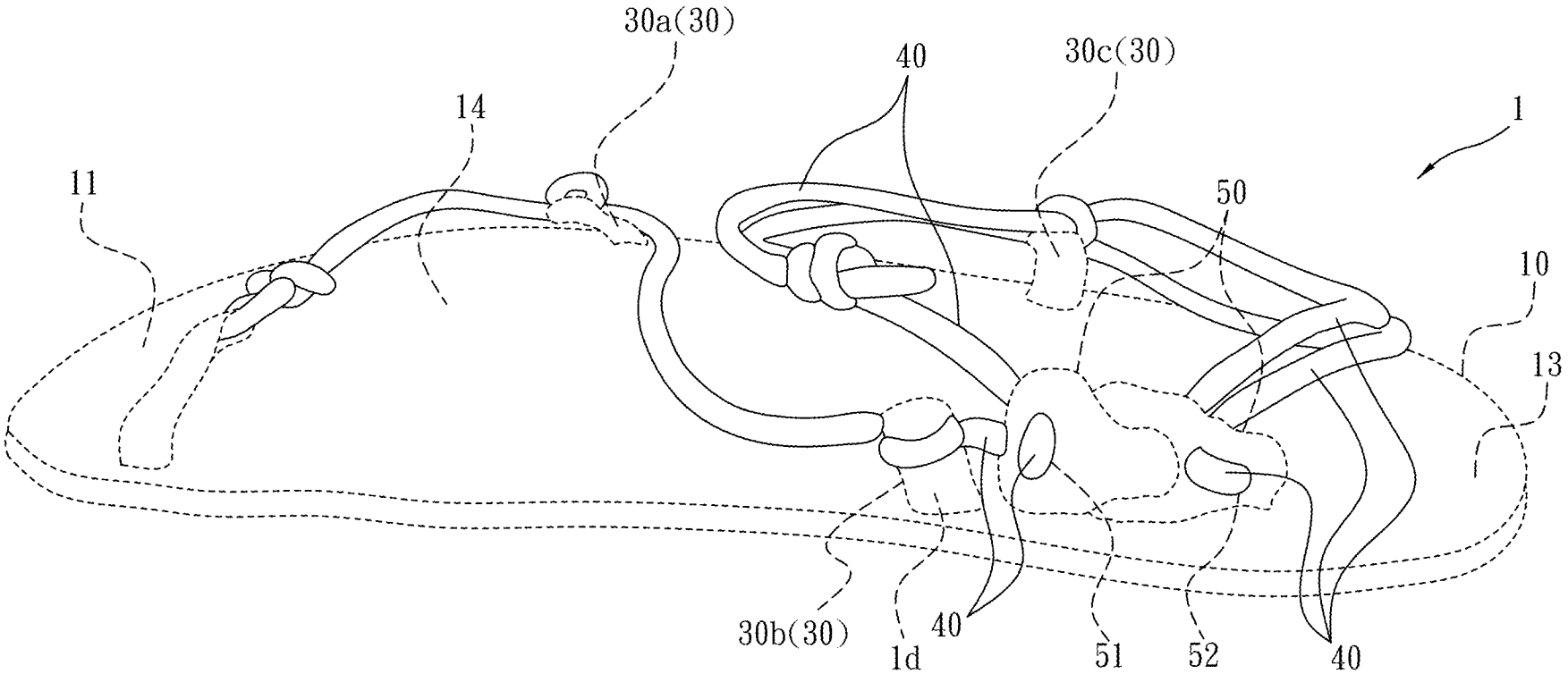
FIG. 10 is the embodiment in FIG. 7 viewed from a further angle according to the present invention.

Refer to the embodiment shown in FIG. 7-10, the number of the webbings 30 of the light sandals 1 is three, but not limited. The webbings 30 include a first webbing 30*a*, a second webbing 30*b*, and a third webbing 30*c*. After one end of the strap 40 being fixed, the other end of the strap 40 is inserted through the circular belt 31 of the first webbing 30*a* to form one of the slip knots 41 and then inserted through the circular belt 31 of the second webbing 30*b* to form another one of the slip knots 41. Next the strap 40 is inserted through a first ring 51 of a quick plug-in buckle 50 on the outer side 1*d* and the circular belt 31 of the third webbing 30*c* in turn and a further one of the slip knots 41 is formed on the circular belt 31 of the third webbing 30*c*. Later the strap 40 is inserted through a second ring 52 of a quick plug-in buckle 50 and returned to the circular belt 31 of the third webbing 30*c*. At last the other end of the strap 40 is fixed on a segment of the strap 40 between the circular belt 31 of the third webbing 30*c* and the first ring 51, as shown in FIG. 10. Refer to FIG. 13, both the segment of the strap 40 between the circular belt 31 of the third webbing 30*c* and the first ring 51 and a segment of the strap 40 between the circular belt 31 of the third webbing 30*c* and the second ring 52 are used for fixing an user's 2 heel 2*b*. Refer to FIG. 10, the quick plug-in buckle 50 is used to adjust a length of the segment of the strap 40 between the circular belt 31 of the third webbing 30*c* and the first ring 51 or a length of the segment of the strap 40 between the circular belt 31 of the third webbing 30*c* and the second ring 52.

Figure 11:
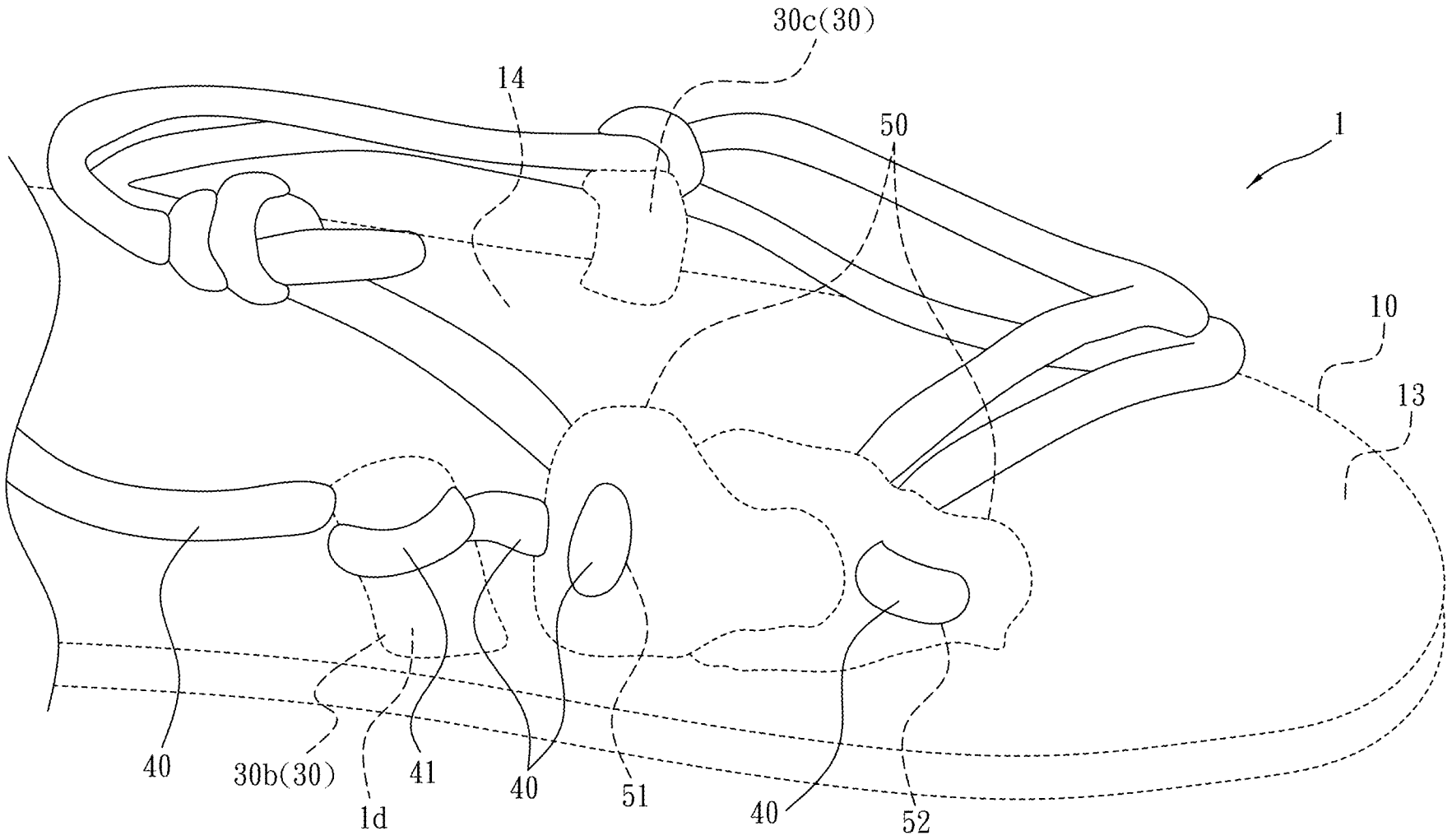
FIG. 11 is a partial enlarged view of the embodiment in FIG. 10 according to the present invention.
Figure 12:
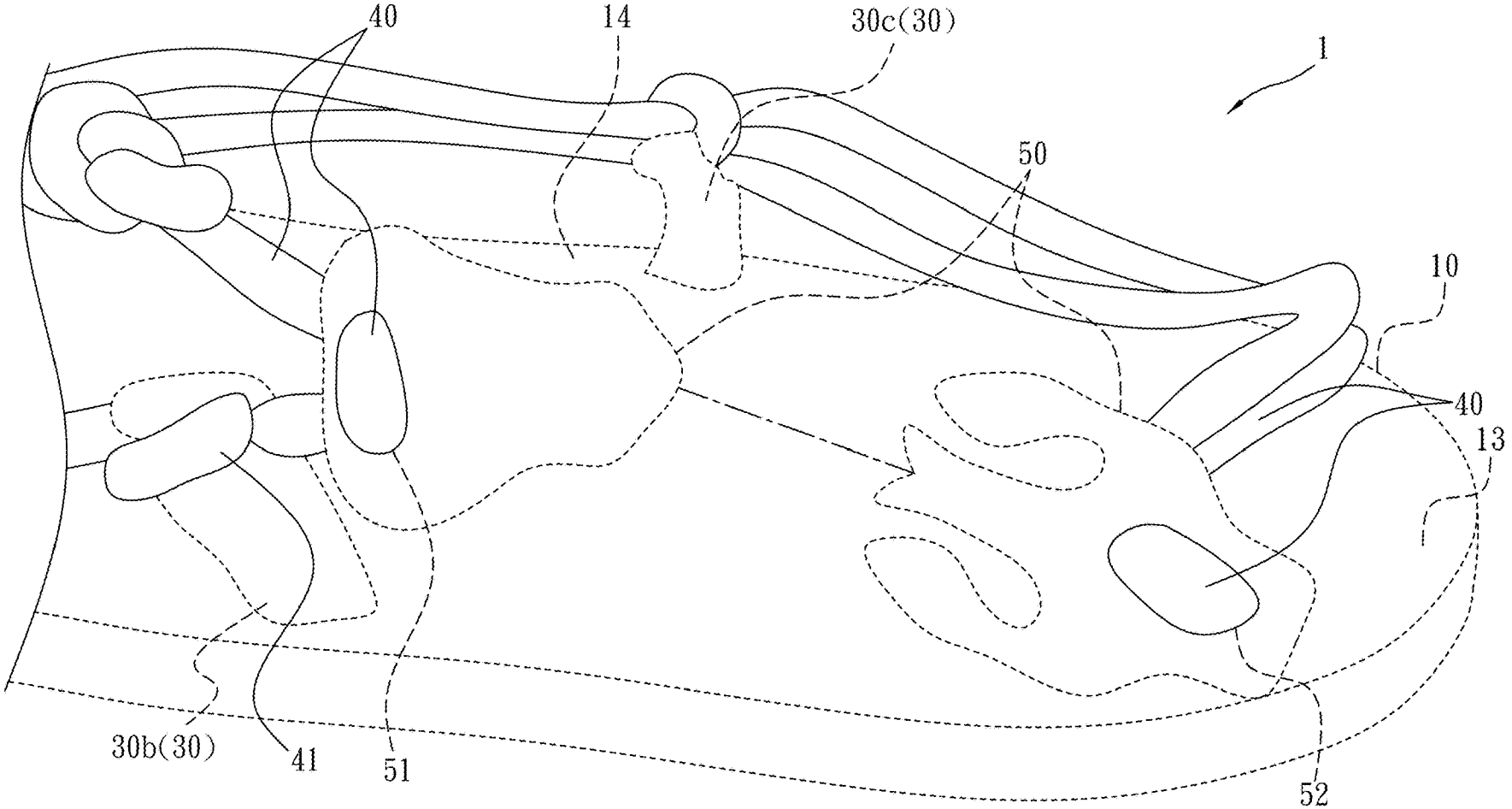
FIG. 12 is a schematic drawing showing the embodiment of a quick plug-in buckle in FIG. 11 released from a locked state according to the present invention.

Refer to FIG. 11 and FIG. 12, the quick plug-in buckle 50 can be in a locked state or a released state according to users' needs. The applications of the quick plug-in buckle 50 are common techniques available now and thus not described in detail herein.

Figure 16:
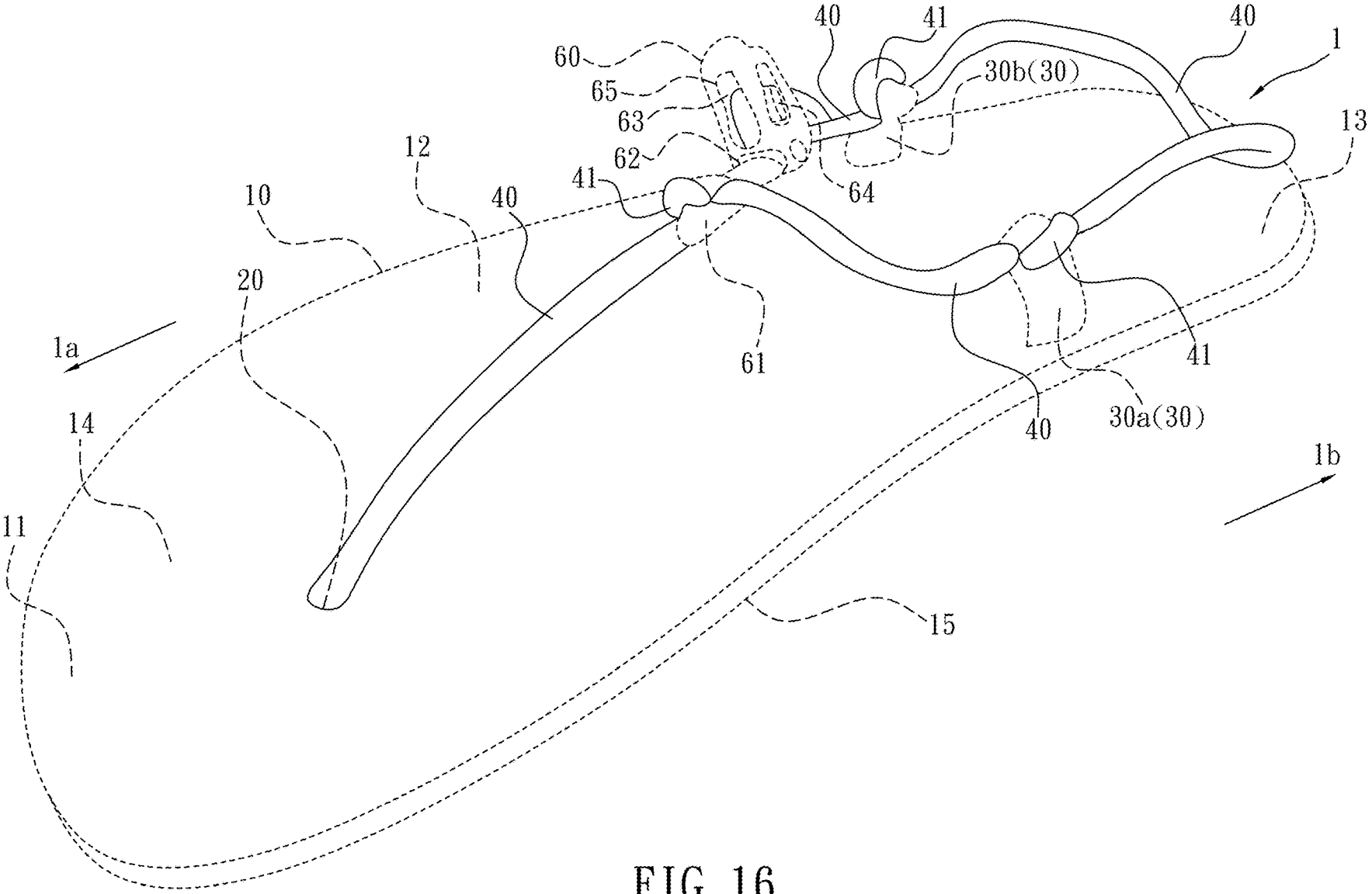
FIG. 16 is a perspective view of a further embodiment (light sandals with a middle fastener) according to the present invention.
Figure 17:
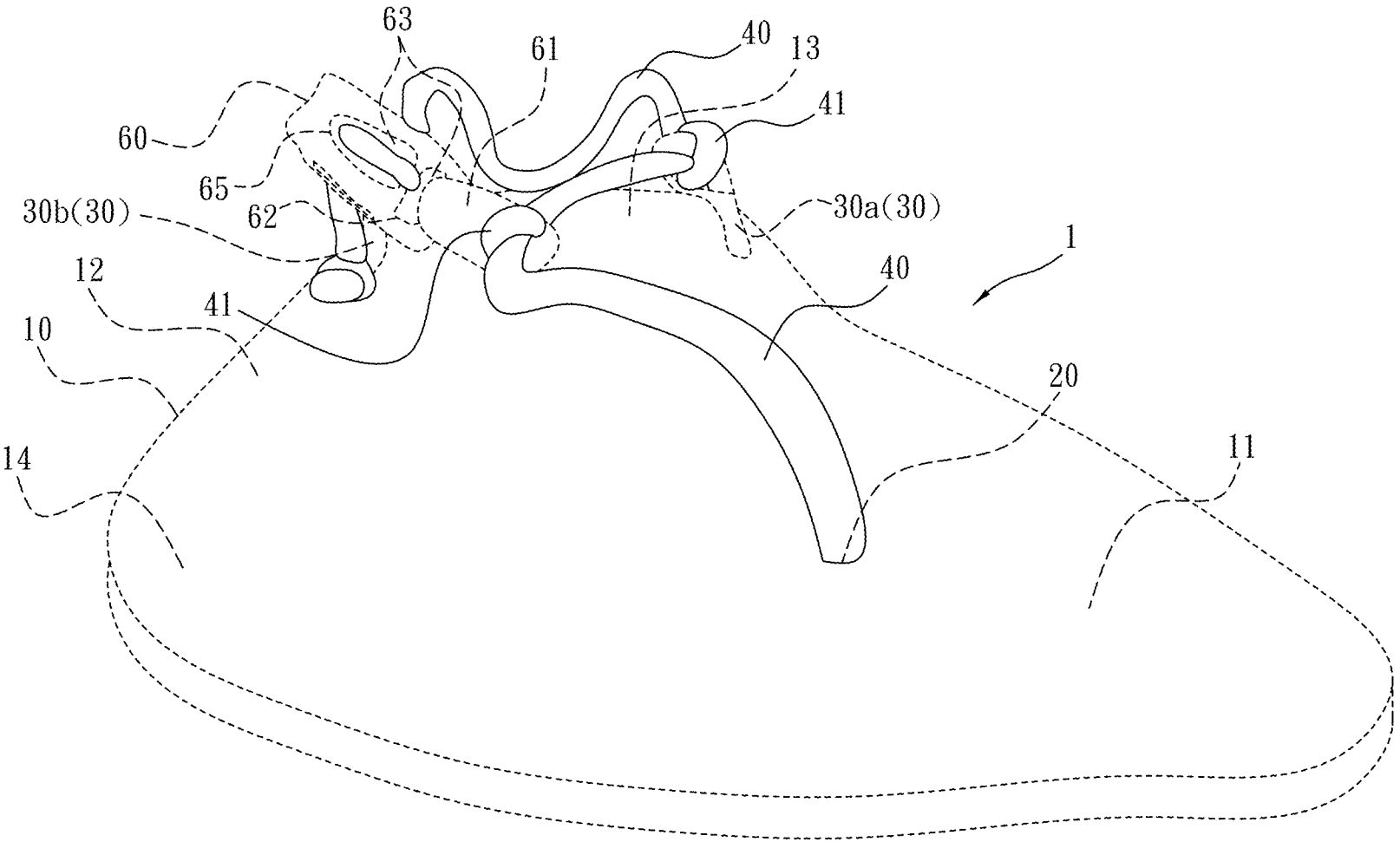
FIG. 17 is an exploded view of the embodiment in FIG. 1 according to the present invention.
Figure 18:
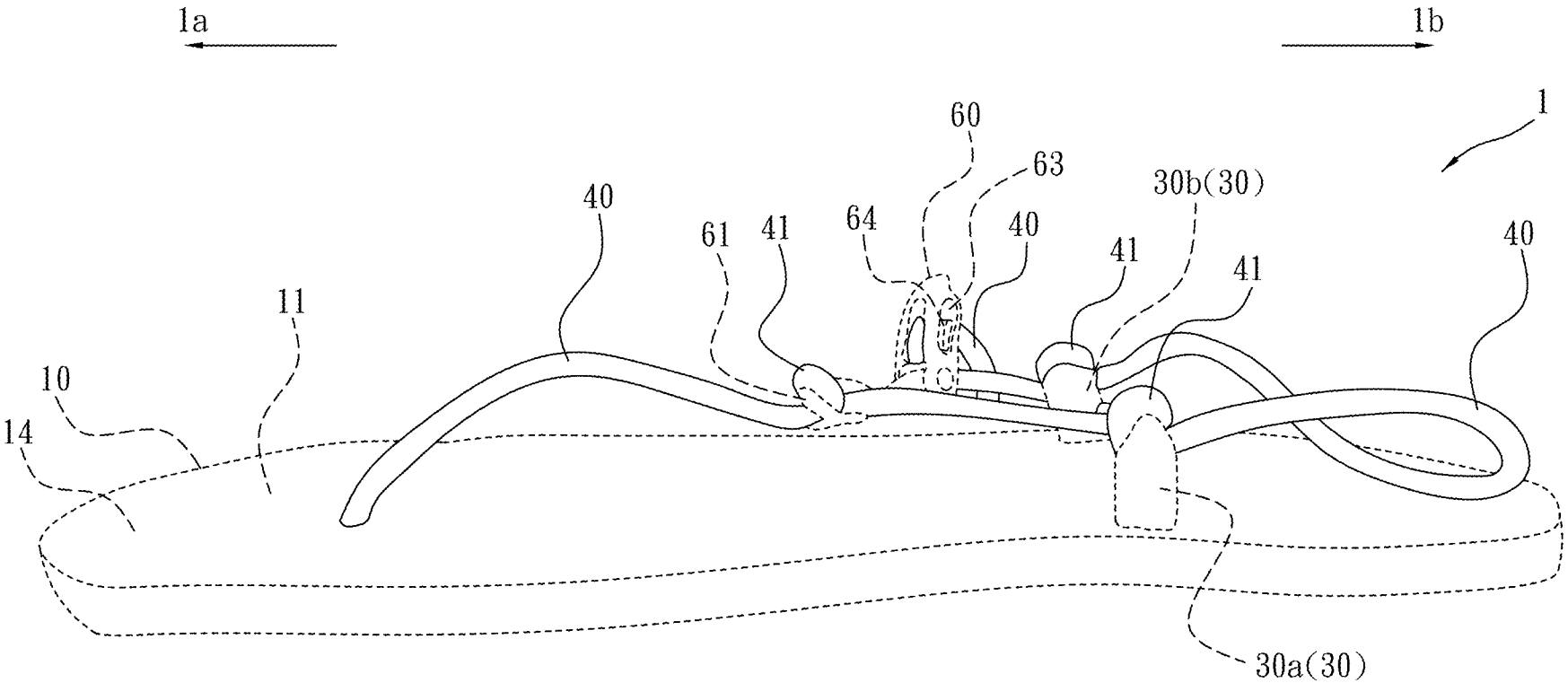
FIG. 18 is the embodiment in FIG. 1 viewed from another angle according to the present invention.
Figure 19:
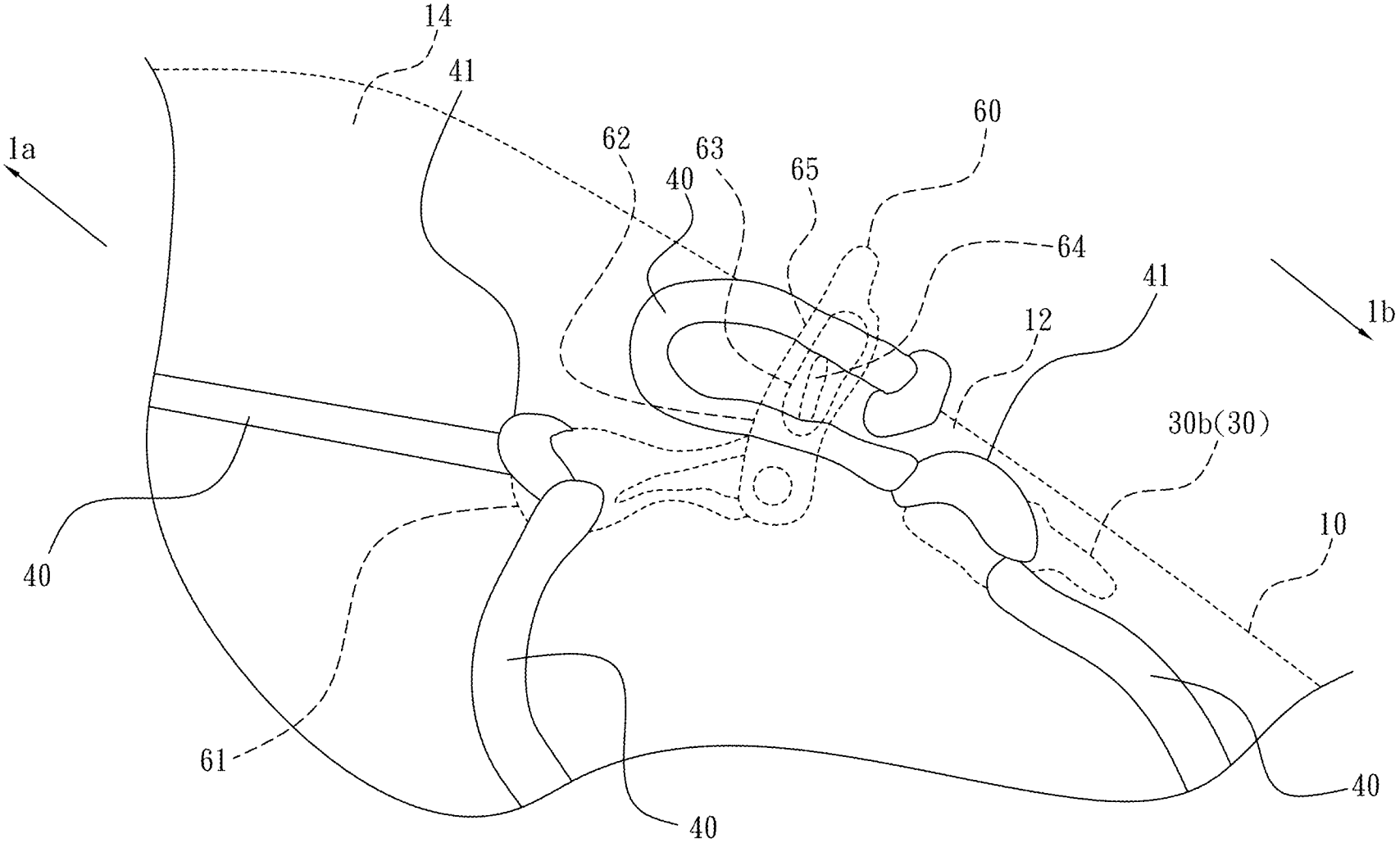
FIG. 19 is a partial enlarged view showing a middle fastener of light sandals of an embodiment according to the present invention.
Figure 20:
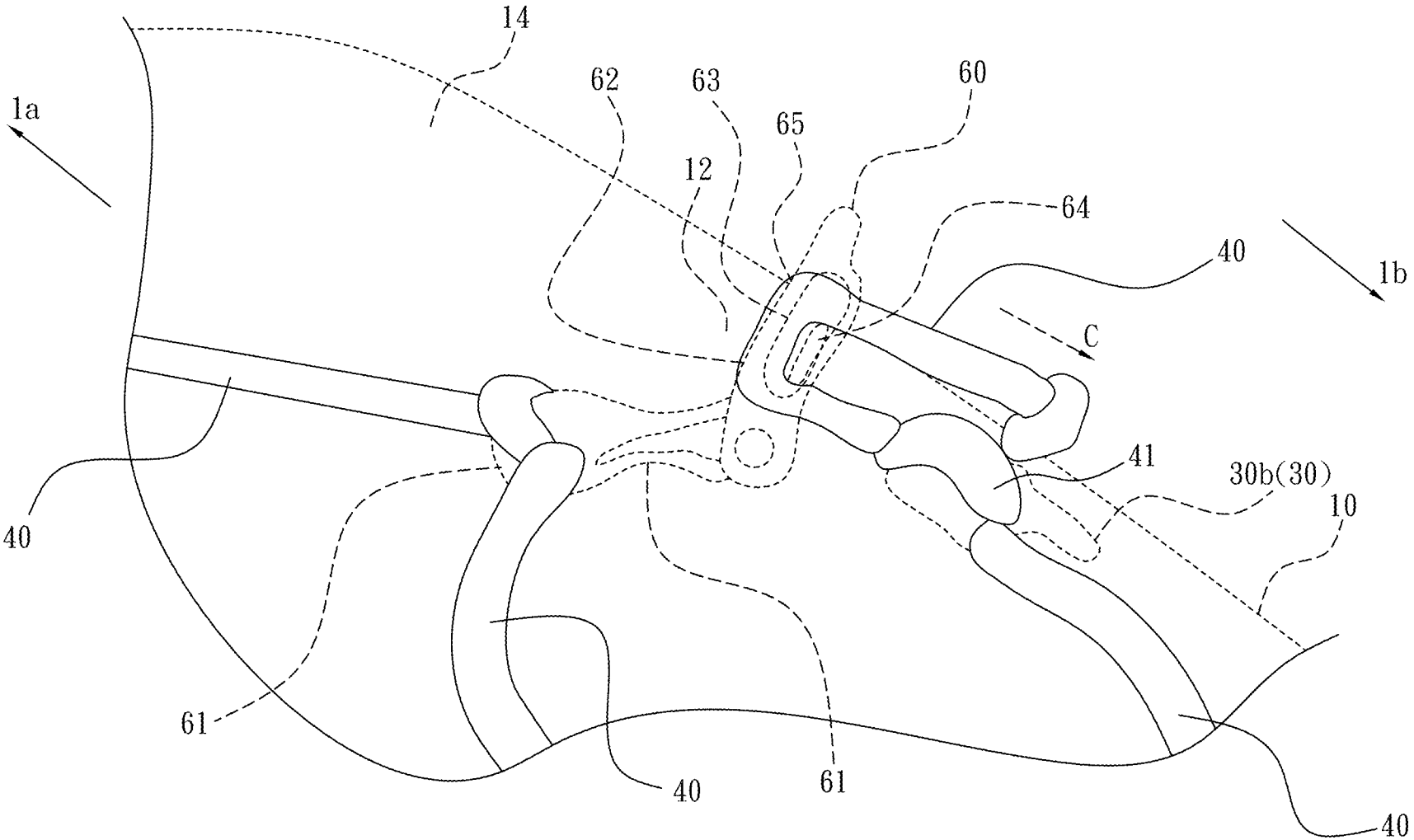
FIG. 20 is a schematic drawing showing the middle fastener of the embodiment in FIG. 19 in a locked state according to the present invention.

Refer to an embodiment revealed in FIG. 16-18, the number of the webbings 30 of the light sandals 1 is two, but not limited. Refer to FIG. 19 and FIG. 20, the light sandals 1 further includes a middle fastener 60 located at a space above the middle part 12 of the shoe sole 10 and composed of a ring belt 61, a first ring 62, a mounting space 63, a fixing piece 64, and a second ring 65. The first ring 62 and the second ring 65 are both communicating with the mounting space 63 while the fixing piece 64 is located in the mounting space 63 and arranged between the first ring 62 and the second ring 65. Refer to FIG. 16, after one end thereof being fixed, the other end of the strap 40 is inserted through the ring belt 61 of the middle fastener 60 and a slip knot 41 is formed. Then the strap 40 is further inserted through the circular belt 31 of the first webbing 30*a* and another slip knot 41 is formed. Next the strap 40 is pulled from the rear side 1*b* toward the front side 1*a* and inserted through the circular belt 31 of the second webbing 30*b* and a further slip knot 41 is formed. Later the strap 40 is inserted through the first ring 62 of the middle fastener 60 and pulled out of the middle fastener 60 to be inserted through the second ring 65 of the middle fastener 60, as shown in FIG. 19. The strap 40 is protruding from the middle fastener 60 and pulled tightly (as an arrow C in FIG. 20 indicates) to be in a fixed state. Now the fixing piece 64 in the mounting space 63 tightens and positions a segment of the strap 40 from the first ring 62 to the second ring 65 on the middle fastener 60, as shown on FIG. 20. A segment of the strap 40 between the circular belt 31 of the first webbing 30*a* and the circular belt 31 of the second webbing 30*b* is used to fix the user's heel. The middle fastener 60 is used to adjust a length of a segment of the strap 40 between the circular belt 31 of the second webbing 30*b* and the second ring 65, as shown in FIG. 16.

Refer to the embodiment shown in FIG. 1-4, the webbings 30 of the rear part 13 of the shoe sole 10 can be connected into one part by a heel webbing 70 with an adjustable length, but not limited. The heel webbing 70 is used to fix the user's heel.

Refer to FIG. 1, FIG. 7, FIG. 16, and FIG. 22, before being mounted to the shoe sole 10, the front fixing member 20 and the webbings 30 are first applied with glues by glue dispensing techniques and then mounted to the shoe sole 10 so that the assembly of the front fixing member 20 and the webbings 30 with the shoe sole 10 is secured more firmly.

In summary, the tightness of the strap of the sandals available now can't be adjusted over various stages or at different areas. That means the strap used now is unable to be adjusted according to different areas of the user's foot including a width of the forefoot and a thickness of the instep. The strap can only be adjusted once for changing fitness between the sandals and the whole foot. However, in the tightness adjustment state of the present light sandals 1 (as shown in FIG. 5), the length of the segment of the strap 40 between the front fixing member 20 and the respective slip knots 41 or the length of the strap 40 between the two adjacent slip knots 41 is decreased or increased, as shown in FIG. 1. While in the stop adjustment state (as shown in FIG. 6), the length of the segment of the strap 40 between the front fixing member 20 and the respective slip knots 41 or the length of the segment of the strap 40 between the two adjacent slip knots 41 is fixed, as shown in FIG. 1. That means the length of different segments of the strap 40 of the present light sandals 1 over different areas of the user's foot including the width of the forefoot and the thickness of the instep can be adjusted. Such design helps increase market competitiveness of the present product.

Moreover, the strap 40 is firstly inserted through the respective circular belts 31 toward the rear side 1*b*, then wound around the outer side 1*d*, and lastly inserted through the respective circular belts 31 toward the rear side 1*b* again and tied on the respective circular belts 31 to form the respective slip knots 41. The strap 40 firstly inserted through the circular belt 31 is pressed under the strap 40 inserted through again later to form the backward strap 411 while the strap 40 pressing over the backward strap 411 forms the frontward strap 412. The respective slip knots 41 are located in a range of the outer side 1*d*, opposite to the inner side 1*c*. As shown in FIG. 5, when the slip knot 41 is at the state for adjustment of tightness, the frontward strap 412 and the backward strap 411 can be respectively pulled toward the front side 1*a* (as the arrow A in FIG. 6 indicates) and the rear side 1*b* a (as the arrow B in FIG. 6 indicates) continuously. Refer to FIG. 6, when the slip knot 41 is at the state of stopping adjustment, the frontward strap 412 and the backward strap 411 are respectively pulled tightly toward the front side 1*a* and the rear side 1*b* and secured on the respective circular belts 31. That means the tightness of the strap of the present light sandals 1 can be adjusted without using additional parts (such as locking rings or fasteners). By the specific knotting process mentioned above, the respective knots used for tightness adjustment of the strap 40 can be formed under the condition that only one strap is used. This helps reduction of the manufacturing cost.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

The invention claimed is:

1. An light weight sandals configured to be worn on a sole of a user and having a front side, a rear side, an inner side, and an outer side configured to attach to a user's sole comprising:

a shoe sole having a front part, a middle part, and a rear part in turn according to the front side and the rear side of the sandals; the shoe sole provided with a front surface and a back surface;

a front fixing member detachably mounted to the front part of the shoe sole;

at least two webbings detachably disposed on the front surface of the shoe sole and each of the webbings provided with a circular belt and a fixing end; the circular belt located at an upper end of the webbing and having a front opening and a rear opening respectively toward the front side and the rear side; the fixing end located opposite to the circular belt and at a lower end of the webbing for being fixed on the shoe sole; and a strap detachably arranged at the shoe sole and having a circular cross section; the strap forming a slip knot on each of the circular belts; wherein the strap is inserted through the respective circular belts toward the rear side, wrapped around the outer side, and inserted through the respective circular belts toward the rear side again to be tied on the respective circular belts to form the slip knots; a part of the strap firstly inserted through the circular belt is pressed under a part of the strap inserted through again later to form a backward strap while a part of the strap pressing the backward strap forms a frontward strap; the respective slip knots are located within the outer side, opposite to the inner side; wherein the frontward strap and the backward strap are respectively able to be pulled toward the front side and the rear side continuously when the slip knot is in a tightness adjustment state; wherein the frontward strap and the backward strap are respectively pulled tightly toward the front side and the rear side and tied securely on the corresponding circular belts when the slip knot is in a stop adjustment state;

wherein while being assembled, the front fixing member and the webbings are mounted to the shoe sole; after one end of the strap being fixed on the front fixing member, the other end of the strap is inserted through the circular belts of the webbings in turn from the front side to the rear side; the strap is firstly forming the slip knot in the circular belt of a previous webbing and then is inserted through the circular belt of a next webbing; at last the strap is fixed to complete assembly of the light sandals;

wherein a segment of the strap between the front fixing member and the respective slip knots, or a segment of the strap between the two adjacent slip knots is configured to be used to fix the user's sole on the front surface of the shoe sole;

wherein in the tightness adjustment state, a length of the strap between the front fixing member and the respective slip knots or a length of the strap between the two adjacent slip knots is able to be shortened or increased;

wherein in the stop adjustment state, the length of the strap between the front fixing member and the respective slip knots, or the length of the strap between the two adjacent slip knots is fixed.

2. The light weight sandals as claimed in claim 1, wherein a diameter of the cross section of the strap is ranging from 2 mm to 7 mm.

3. The light weight sandals as claimed in claim 1, wherein the front surface of the shoe sole is further provided with a plurality of fixing slots; wherein the front fixing member and the fixing end of each of the webbings are mounted into the corresponding fixing slots of the shoe sole.

4. The light weight sandals as claimed in claim 1, wherein a plurality of insertion holes are is disposed on the shoe sole; a bottom of the front fixing member is further provided with a stopping portion; wherein the front fixing member is inserted through an insertion hole on the front part of the shoe sole from bottom to top and abutting against an insertion hole by the stopping portion to be secured on the shoe sole.

5. The light weight sandals as claimed in claim 1, wherein the front part, the middle part, and the rear part of the shoe sole are further provided with a plurality of insertion holes; the fixing end of the webbing is a T-shaped abutting member formed by two pieces of webbings together with glue dispensing fixing technique; the respective webbings are inserted through the corresponding insertion holes from bottom to top and abutting against the insertion holes by the T-shaped abutting members to be secured on the shoe sole.

6. The light weight sandals as claimed in claim 1, wherein the front fixing member further includes a front fixing webbing which is provided with a ring band; wherein while being assembled, the strap firstly forms a front fixing knot on the ring band of the front fixing webbing and then inserted toward the rear side; the front fixing knot is located at the outer side, opposite to the inner side.

7. The light weight sandals as claimed in claim 1, wherein the number of the webbings of the light weight sandals is three and the webbings include a first webbing, a second webbing, and a third webbing; wherein after one end of the strap being fixed, the other end of the strap is inserted through the circular belt of the first webbing to form one of the slip knots and then inserted through the circular belt of the second webbing to form another one of the slip knots; next the strap is inserted through a first ring of a quick plug-in buckle on the outer side and the circular belt of the third webbing in turn and a further one of the slip knots is formed on the circular belt of the third webbing; later the strap is inserted through a second ring of the quick plug-in buckle and returned to the circular belt of the third webbing; at last the other end of the strap is fixed on a segment of the strap between the circular belt of the third webbing and the first ring; wherein both the segment of the strap between the circular belt of the third webbing and the first ring and a segment of the strap between the circular belt of the third webbing and the second ring configured to fix a user's heel to the sole; wherein the quick plug-in buckle is used to adjust a length of the segment of the strap between the circular belt of the third webbing and the first ring or a length of the segment of the strap between the circular belt of the third webbing and the second ring.

8. The light weight sandals as claimed in claim 1, wherein the number of the webbings of the light weight sandals is two; the webbings include a first webbing and second webbing; wherein the light sandals further includes a middle fastener located at a space above the middle part of the shoe sole and composed of a ring belt, a first ring, a mounting space, a fixing piece, and a second ring; the first ring and the second ring are both communicating with the mounting space while the fixing piece is located in the mounting space and arranged between the first ring and the second ring; wherein after one end thereof being fixed, the other end of the strap is pulled through the ring belt of the middle fastener and the first one of the slip knots is formed; then the strap is further inserted through the circular belt of the first webbing and another one of the slip knots is formed; next the strap is pulled from the rear side toward the front side and inserted through the circular belt of the second webbing to form the further one of the slip knots; later the strap is inserted through the first ring of the middle fastener and pulled out of the middle fastener to be inserted through the second ring of the middle fastener; and the strap is protruding from the middle fastener and pulled tightly to be in a fixed state; now the fixing piece in the mounting space tightens and positions a segment of the strap from the first ring to the second ring on the middle fastener; wherein a segment of the strap between the circular belt of the first webbing and the circular belt of the second webbing configured to fix a user's heel to the sole; wherein the middle fastener is for adjusting a length of a segment of the strap between the circular belt of the second webbing and the second ring.

9. The light weight sandals as claimed in claim 1, wherein the webbings of the rear part of the shoe sole are connected into one part by a heel webbing with an adjustable length; the heel webbing configured to fix a user's heel to the sole.

10. The light weight sandals as claimed in claim 1, wherein before being mounted to the shoe sole, the front fixing member and the webbings are applied with glues and then mounted to the shoe sole.

* * * * *